United States Patent [19]

Umemoto et al.

[11] Patent Number: 4,767,697

[45] Date of Patent: Aug. 30, 1988

[54] SILVER HALIDE COLOR PHOTOGRAPHIC MATERIAL

[75] Inventors: Makoto Umemoto; Yoshio Seoka; Masakazu Morigaki, all of Minami-ashigara, Japan

[73] Assignee: Fuji Photo Film Co., Ltd., Kanagawa, Japan

[21] Appl. No.: 820,387

[22] Filed: Jan. 21, 1986

[30] Foreign Application Priority Data

Jan. 21, 1985 [JP] Japan ..... 60-8755

[51] Int. Cl.[4] ..... G03C 7/34

[52] U.S. Cl. ..... 430/546; 430/548; 430/551

[58] Field of Search ..... 430/546, 551, 552, 553, 430/548

[56] References Cited

U.S. PATENT DOCUMENTS

| | | | |
|---|---|---|---|
| 2,895,826 | 7/1959 | Salminen et al. | 430/552 |
| 2,908,573 | 10/1959 | Bush et al. | 430/552 |
| 3,432,300 | 3/1969 | Lestina et al. | 430/551 |
| 3,573,050 | 3/1971 | Brannock et al. | 430/551 |
| 3,698,909 | 10/1972 | Lestina et al. | 430/546 |
| 3,764,337 | 10/1973 | Arai et al. | 430/551 |
| 4,080,209 | 3/1978 | Mukunoki et al. | 430/546 |
| 4,193,802 | 3/1980 | Mukunoki et al. | 430/546 |
| 4,254,216 | 3/1981 | Uchida et al. | 430/551 |
| 4,455,367 | 6/1984 | Seoka et al. | 430/546 |
| 4,477,558 | 10/1984 | Ogawa et al. | 430/546 |
| 4,559,297 | 12/1985 | Seto et al. | 430/551 |

FOREIGN PATENT DOCUMENTS

| | | |
|---|---|---|
| 116428 | 1/1984 | European Pat. Off. . |
| 1583780 | 7/1977 | United Kingdom . |
| 1590806 | 8/1977 | United Kingdom . |
| 2004078 | 9/1978 | United Kingdom . |

*Primary Examiner*—Richard L. Schilling

*Attorney, Agent, or Firm*—Birch, Stewart, Kolasch & Birch

[57] ABSTRACT

Photographic coupler solvents which are solid at ordinary temperature are described for incorporation in photographic emulsions and elements. The solvents are employed in combination with a cyan dye forming coupler of the specific phenol type and a discoloration inhibitor of the dihydroxybenzene ether type to improve long-term preservability of the developed cyan dye particularly by exposure to mild heat and humidity.

19 Claims, No Drawings

SILVER HALIDE COLOR PHOTOGRAPHIC MATERIAL

FIELD OF THE INVENTION

This invention relates to a color photographic material providing a color photographic image of excellent preservability and, more particularly, to a silver halide color photographic material which forms a color image having high fastness on exposure to heat and light and which scarcely loses color balance even after storage for a long period of time by means of a specific combination of a cyan image-forming coupler (the term "cyan coupler" is used hereafter), an organic solvent and a discoloration inhibitor.

BACKGROUND OF THE INVENTION

In forming color photographic images, exposed light-sensitive materials having yellow, magenta and cyan photographic couplers in blue-sensitive, green-sensitive and red-sensitive layers, respectively, are subjected to color development processing using a color developing agent. In development processing, an oxidation product of an aromatic primary amine undergoes a coupling reaction with each of the above described couplers to give color dyes.

It is fundamentally important for the color dyes formed to be bright cyan, magenta and yellow dyes with minimal side absorptions, in order to provide color photographic images having well reproduced colors.

On the other hand, preservability of the color photographic image is also extremely important, and the color photographic images formed should have good preservability (e.g. image stability) under various conditions.

In order to improve preservability or image stability, it is necessary not only to delay the fading or color changing rates of color dyes of different hues, but it is also necessary that the fading rates of each color forming the image be as uniform as possible, to preserve the color balance of the remaining dye image.

However, conventional photographic materials, particularly color papers, suffer serious deterioration of the cyan dye image after long period of dark fading due to the influence of humidity and heat, thus exhibiting a change in color balance and, therefore, requires improvement. On the other hand, conventional color dyes which scarcely fade in the dark have the contrary disadvantages of poor color hues and provides cyan dye images which fade or disappear on exposure to light. For these reasons, it is desired to develop color photographic materials overcoming these problems.

Specific combinations of high-boiling organic solvents and cyan couplers have been proposed partly to solve these problems, as disclosed in, for example, Japanese Patent Application (OPI) No. 54-99432 (the term "OPI" as used herein refers to a "published unexamined Japanese patent application open to public inspection"), Japanese Patent Publication No. 59-33904, Japanese Patent Application (OPI) Nos. 59-105645 and 59-105646. Specific combinations of couplers have also been proposed as disclosed in Japanese Patent Publication No. 52-7344, Japanese Patent Application (OPI) Nos. 57-200037 and 59-57238, etc. However, these combinations provide only insufficient color forming properties or provide dyes of poor hue, thus being unsatisfactory for color reproduction. Particularly, the color balance of residual dye images changes as a result of deterioration on exposure to light or heat. Therefore, improvement of the combination is desired.

The present invention intends to provide a color photographic material which overcomes the defects of conventional color photographic materials described above.

SUMMARY OF THE INVENTION

In accordance with the present invention a color photographic material which contains a combination of specific cyan couplers, organic coupler solvents and discoloration inhibitors in a silver halide emulsion layer is provided.

An object of the present invention is to provide a silver halide color photographic material which possesses good color forming properties and provides a color photographic image with good reproducibility and improved image preservability and, particularly, undergoes no significant change in color balance for a long period of time both on exposure to light and in the dark.

Another object of the present invention is to provide a silver halide color photographic material which provides an image with good preservability that does not lose color balance by improving the fastness of cyan dye image.

Another object of the present invention is to provide a silver halide color photographic material which provides an image with good preservability that does not lose color balance, not only in highly colored areas but also in gradation areas when stored for a long time under a relatively mild temperature range or humidity or both.

A further object of the present invention is to provide a silver halide color photographic material which provides a color image with improved preservability and improved fastness.

Other and further objects, features and advantages of the invention will appear more fully from the following description.

DETAILED DESCRIPTION OF THE INVENTION

The present invention provides a color photographic material which comprises a support having provided thereon a silver halide emulsion layer containing at least one cyan dye forming coupler selected from the compounds represented by formulae [I] and [II], at least one organic solvent which is solid at ordinary temperature and at least one compound selected from the compounds represented by formulae [III] and [IV]:

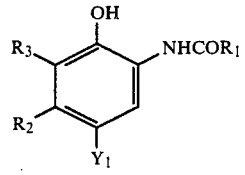

[I]

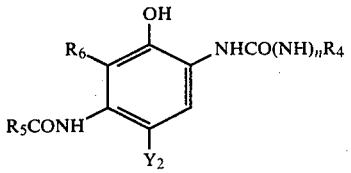

[II]

wherein;

$R_1$, $R_4$ and $R_5$ each represents an aliphatic (substituted or not), aromatic (substituted or not) or heterocyclic (substituted or not) group; $R_3$ and $R_6$ each represents a hydrogen atom, a halogen atom, an aliphatic (substituted or not), aromatic (substituted or not) or acylamino (substituted or not) group; $R_6$ may represent a non-metallic atomic group necessary to form a nitrogen-containing 5- or 6-membered ring together with $R_5$; $R_2$ represents an aliphatic (substituted or not) group; $Y_1$ and $Y_2$ each represents a hydrogen atom or a group (including an atom; hereinafter the same) capable of being eliminated by a coupling reaction with an oxidized developing agent (i.e., a coupling-off group) and n represents 0 or 1.

The compound represented by formulae [I] and [II] may form a dimeric, oligomeric or polymeric coupler by means of one group selected from the groups consisting of $R_2$, $R_3$ and $Y_1$ or from the group consisting of $R_5$, $R_6$ and $Y_2$. Formulae [III] and [IV] are represented by the following formulae:

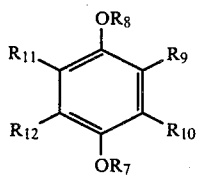

[III]

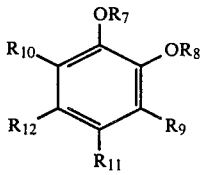

[IV]

wherein;

$R_7$ represents an alkyl, alkenyl, aryl, heterocyclic or

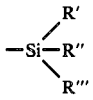

group; R', R'' and R''', which may be the same or different, each represents an alkyl, alkenyl, aryl, alkoxy, alkenoxy or aryloxy group; $R_8$ represents a hydrogen or means the same as $R_7$; $R_9$, $R_{10}$, $R_{11}$ and $R_{12}$, which may be the same or different, each represents a hydrogen atom, an alkyl, alkenyl, aryl, alkoxy, aryloxy, alkylthio, arylthio, alkylamino or acylamino group, a halogen atom, an acyl, alkoxycarbonyl, aryloxycarbonyl, acyloxy, sulfonyl, sulfamoyl, sulfonamide or heterocyclic group. At least one combination selected from $R_7$ and $R_{10}$, $R_8$ and $R_9$, or $R_{11}$ and $R_{12}$ may be connected to each other to form a 5- or 6-membered ring or a spiro ring. Further, two groups located at an adjacent position to each other (i.e., ortho position) among the groups $R_9$ through $R_{12}$ may be connected to each other to form a 5- to 7-membered cycloaliphatic, aromatic, heterocyclic or heteroaromatic ring.

As used herein, the term "aliphatic group" means any of a straight, branched or cyclic aliphatic hydrocarbon group, and includes saturated groups (e.g., alkyl) and unsaturated groups (e.g., alkenyl or alkynyl).

Cyan couplers represented by the foregoing formula [I] or [II] used in the present invention are described in more detail below.

In formula [I] or [II], $R_1$, $R_4$ and $R_4$ each represents an aliphatic hydrocarbon group containing 1 to 31 carbon atoms (e.g., methyl, butyl, octyl, tridecyl, isohexadecyl or cyclohexyl) or an aryl group containing 6 to 31 carbon atoms (e.g., phenyl or naphthyl) or a heterocyclic group containing 1 to 31 carbon atoms (e.g., 2-pyridyl, 2-thiazolyl, 2-imidazolyl, 2-furyl or 6-quinolyl) all of which may optionally be substituted with one or more substituents. Such substituents are selected from an alkyl group, an aryl group, a heterocyclic group, an alkoxy group (e.g. methoxy, 2-methoxyethoxy, or tetradecyloxy), an aryloxy group (e.g., 2,3-di-tert-amylphenoxy, 2-chlorophenoxy, 4-cyanophenoxy or 4-butanesulfonyamidophenoxy), an acyl group (e.g., acetyl or benzoyl), an ester group (e.g., ethoxycarbonyl, 2,4-di-tert-amylphenoxycarbonyl, acetoxy, benzoyloxy, butoxysulfonyl or toluenesulfonyloxy), an amido group (e.g., acetylamino, butanesulfonamido, dodecylbenzenesulfonamido or dipropylsulfamoylamino), a carbamoyl group (e.g., dimethylcarbamoyl or ethylcarbamoyl), a sulfamoyl group (e.g., butylsulfamoyl), an imido group (e.g., succinimido or hydantoinyl), a ureido group (e.g., phenylureido or dimethylureido), a sulfonyl group (e.g., methanesulfonyl, carboxymethanesulfonyl or phenylsulfonyl), an aliphatic or aromatic thio group (e.g., butylthio or phenylthio), a hydroxyl group, a cyano group, a carboxyl group, a nitro group, a sulfo group and a halogen atom. When $R_1$, $R_4$ or $R_5$ has two or more of these substituents, the substituents may be the same or different.

In formula [I], $R_2$ represents an aliphatic hydrocarbon group which may be optionally substituted (e.g., methyl, ethyl, propyl, butyl, pentadecyl, tert-butyl, cyclohexyl, cyclohexylmethyl, phenylthiomethyl, dodecycloxyphenylthiomethyl, butaneamidomethyl or methoxymethyl).

$R_3$ in formula [I] represents a hydrogen or halogen atom, a lower alkyl group containing 1 to 5 carbon atoms, an aryl group (e.g., phenyl) or an acylamino group (e.g., acetylamino).

In the foregoing formula [II], $R_6$ preferably represents a hydrogen or halogen atom, an alkyl, aryl or acylamino group containing up to 8 carbon atoms. When $R_6$ forms a ring together with $R_5$, $R_6$ represents non-metallic atoms forming a nitrogen-containing 5- or 6-membered ring. Typical examples of the moieties bridging between 5- and 6-positions of the phenol ring as a result of the ring closure between $R_5$ and $R_6$ groups include

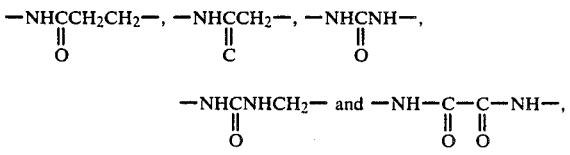

wherein the nitrogen atom of these groups bonds to the 5-position of the phenol ring and wherein the hydrogen atoms of these groups may be substituted with a lower alkyl group containing 1 to 5 carbon atoms. 6-membered rings are more preferable than 5-membered rings. Among couplers having such 6-membered rings of the present invention, 5-hydroxy-3,4-dihydrocarbostyrils are most preferable in view of their light fastness of the developed cyan dye.

$Y_1$ in formula [I] and $Y_2$ in formula [II] each represents a hydrogen atom or a coupling-off group, e.g., a halogen atom (e.g., fluorine, chlorine or bromine), an alkoxy group (e.g., ethoxy, dodecyloxy, methoxyethylcarbamoylmethoxy, carboxypropyloxy or methylsulfonylethoxy), an aryloxy group (e.g., 4-chlorophenoxy, 4-methoxyphenoxy or 4-carboxyphenoxy), an acyloxy group (e.g., acetoxy, tetradecanoyloxy or benzoyloxy), a sulfonyloxy group (e.g., methanesulfonyloxy or toluenesulfonyloxy), an amido group (e.g., dichloroacetylamino, heptafluorobutyrylamino, methanesulfonylamino or toluenesulfonylamino), an alkoxycarbonyloxy group (e.g., ethoxycarbonyloxy or benzyloxycarbonyloxy), an aryloxycarbonyloxy group (e.g., phenoxycarbonyloxy), an aliphatic, aromatic or heterocyclic thio groupo (e.g., ethylthio, phenylthio or tetrazolylthio), an imido group (e.g., succinimido or hydrantoinyl), or an aromatic azo group (e.g, phenylazo). These coupling-off groups may contain a photographically useful group or groups.

Preferred examples of the cyan couplers represented by formula [I] or [II] are as follows.

$R_1$ in formula [I] preferably represents a substituted or unsubstituted alkyl or aryl group, particularly preferably an alkyl group substituted with an aryloxy group which may further be substituted.

$R_2$ in formula [I] preferably represents an unsubstituted alkyl group containing 2 to 15 carbon atoms or a methyl group substituted by one or more substituents containing at least one carbon atom. Preferably examples of such substituents include an arylthio, alkylthio, acylamino, aryloxy or alkyloxy group.

$R_2$ in formula [I] more preferably represents an unsubstituted alkyl group containing 2 to 15 carbon atoms and most preferably represents an ethyl or propyl group.

$R_3$ in formula [I] preferably represents a hydrogen atom or a halogen atom with a chlorine and fluorine atom being particularly preferred.

In formula [I] particularly preferable combination is a chlorine atom for $R_3$ and an alkyl group containing 2 to 15 carbon atoms for $R_2$.

In formula [II], $R_4$ preferably represents an aryl group or a heterocyclic group and, more preferably, an aryl group substituted by at least one substituent selected from a halogen atom, an alkyl, alkoxy, aryloxy, acylamio, acyl, carbamoyl, sulfonamido, sulfamoyl, sulfonyl, sulfamido, hydroxycarbonyl or cyano group.

In general formula [II], where $R_5$ and $R_6$ are not connected to each other to form a ring, $R_5$ preferably represents a substituted or unsubstituted alkyl or aryl group, particularly preferably an alkyl group substituted with an aryloxy group which may further be substituted, and $R_6$ preferably represents a hydrogen atom.

In formulae [I] and [II], $Y_1$ and $Y_2$ preferably each represents a hydrogen atom, a halogen atom, an optionally substituted alkoxy, aryloxy or sulfonamido group.

$Y_1$ in formula [I] preferably represents a halogen atom, with a chlorine or fluorine atom being particularly preferred.

When n in formula [II] represents 0, $Y_2$ more preferably represents a halogen atom, particularly preferably a chlorine or fluorine atom.

Specific examples of the cyan couplers represented by the foregoing formulae [I] and [II] are illustrated below, which, however, should not be construed as limiting the scope of the present invention in any way.

(I-1)

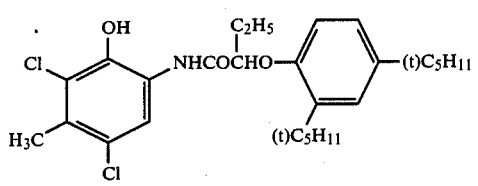

(I-2)

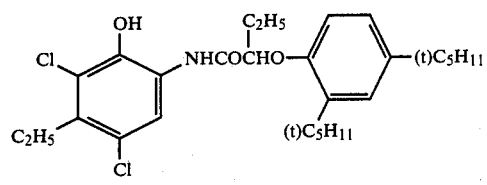

(I-3)

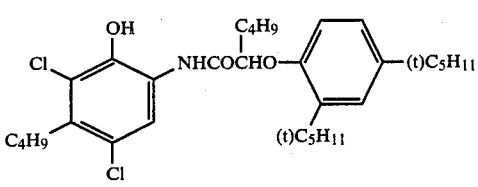

(I-4)

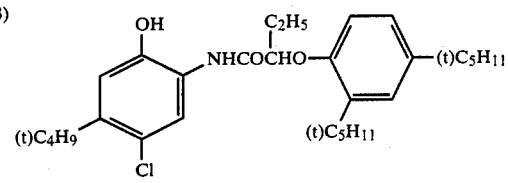

(I-5)

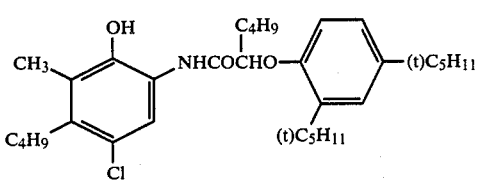

(I-6)

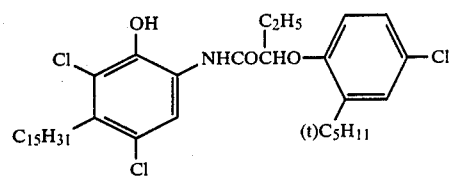

(I-7)

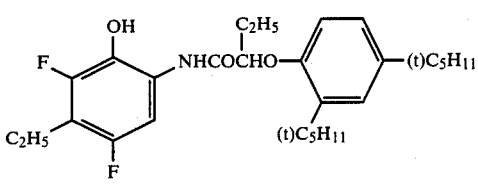

(I-8)

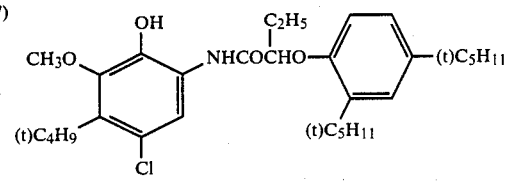

-continued
(I-9)
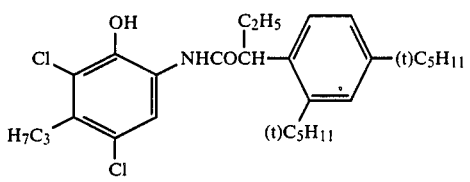
(I-10)
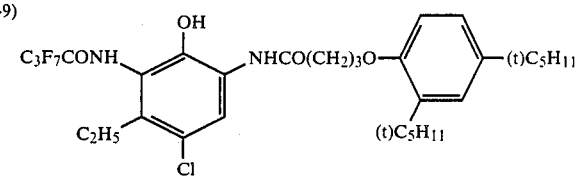
(I-11)
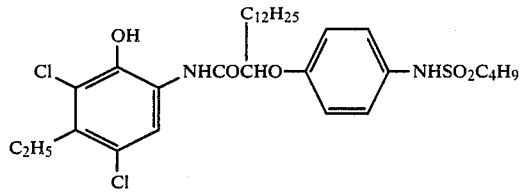
(I-12)
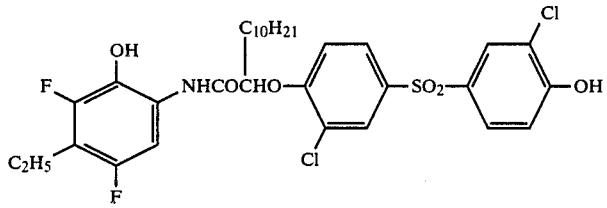
(I-13)
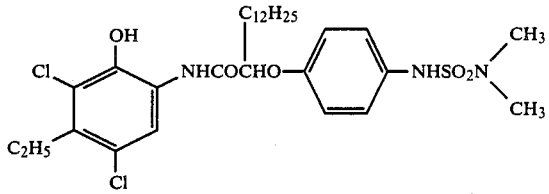
(I-14)
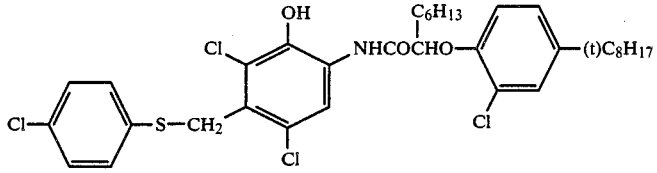
(I-15)
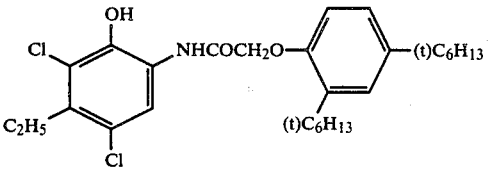
(I-16)
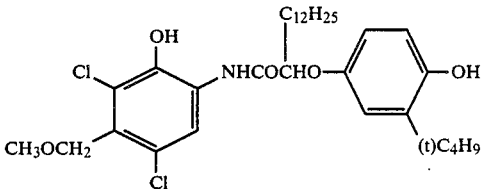
(I-17)
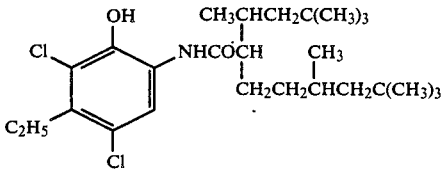
(I-18)
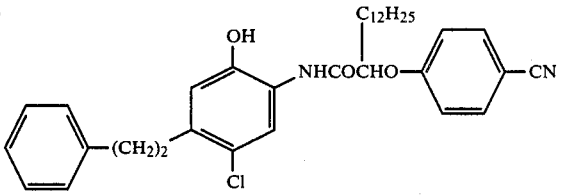
(I-19)
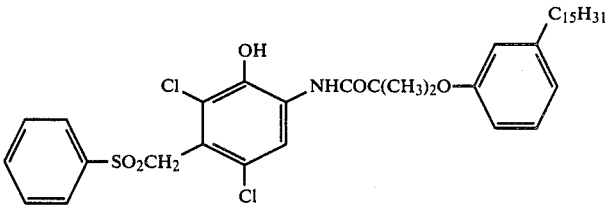

-continued
(I-20)
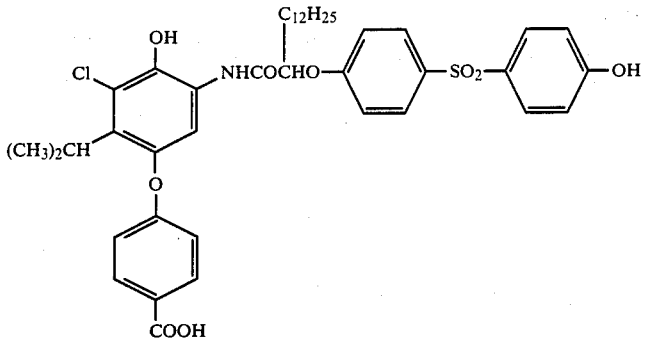
(I-21)
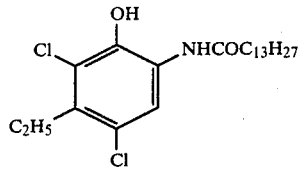
(I-22)
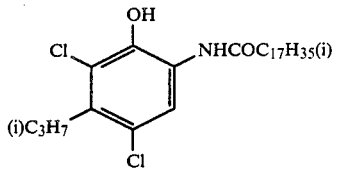
(I-23)
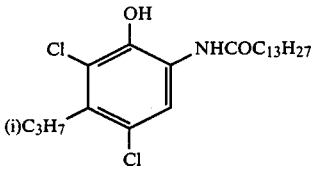
(I-24)
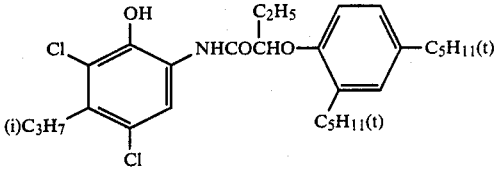
(I-25)
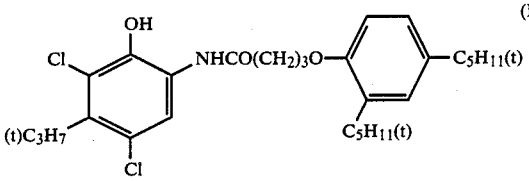
(I-26)
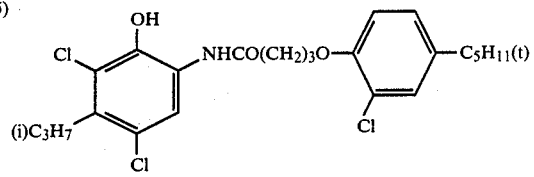
(I-27)
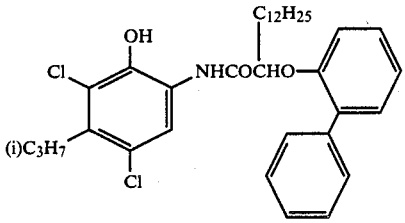
(I-28)
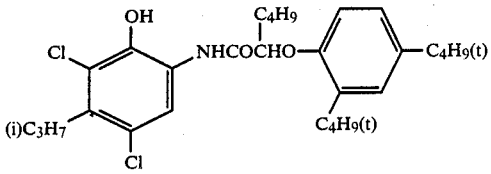
(I-29)
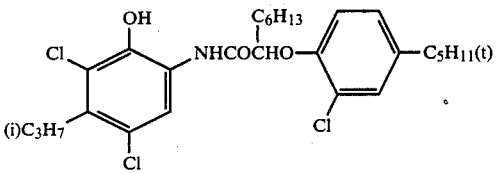
(I-30)
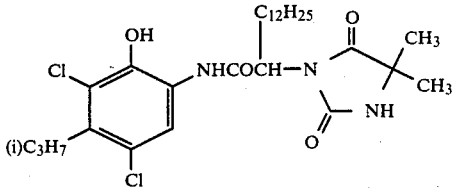
(I-31)
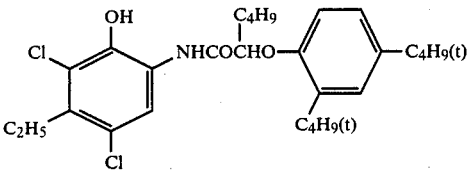
(I-32)
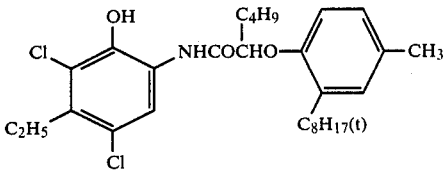

-continued
(I-33)
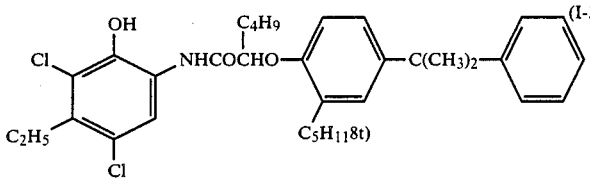
(I-34)
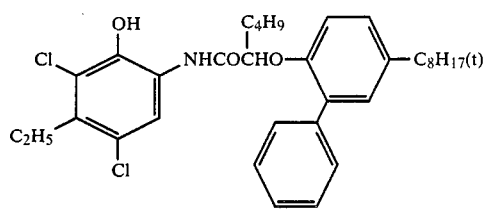
(I-35)
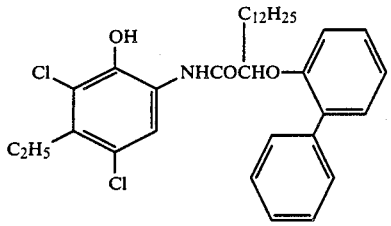
(I-36)
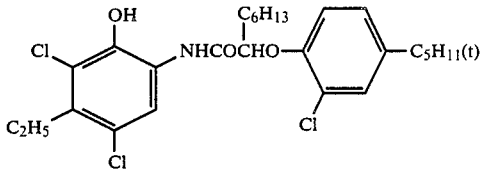
(I-37)
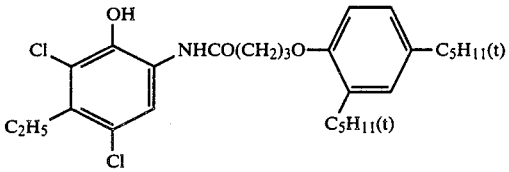
(I-38)
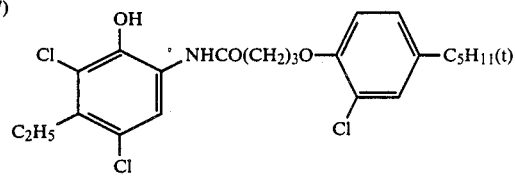
(I-39)
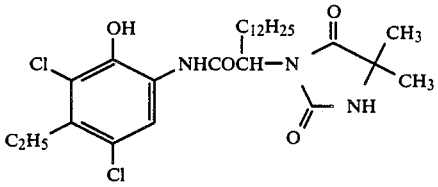
(I-40)
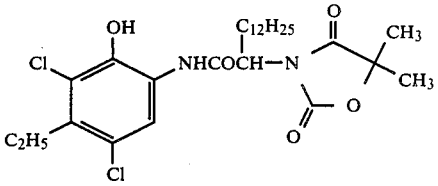
(II-1)
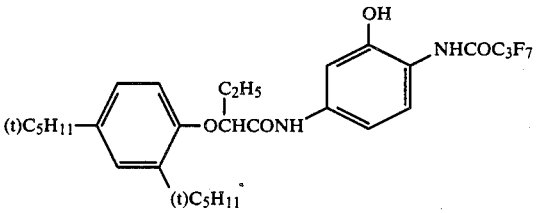
(II-2)
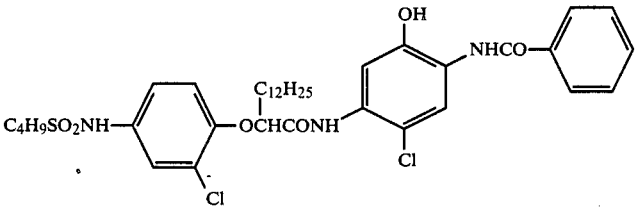
(II-3)
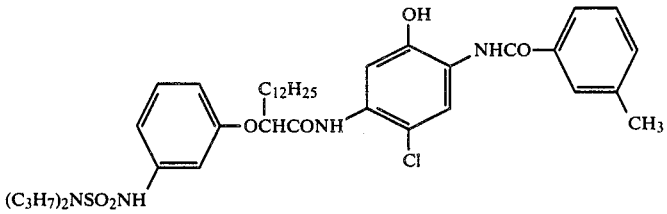

-continued
(II-4)
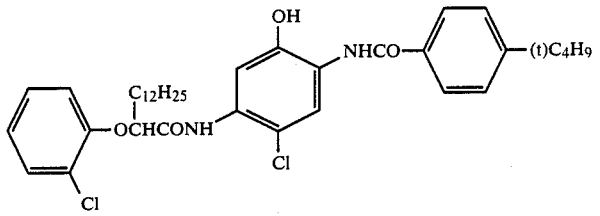
(II-5)
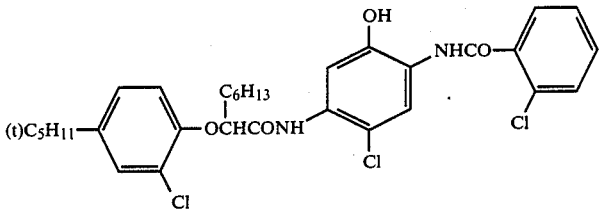
(II-6)
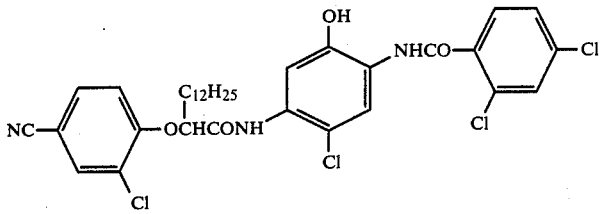
(II-7)
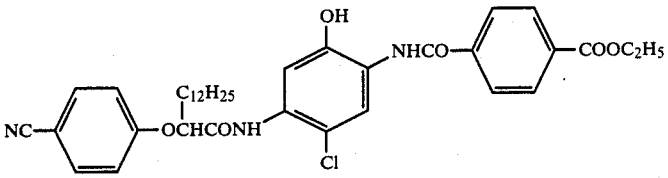
(II-8)
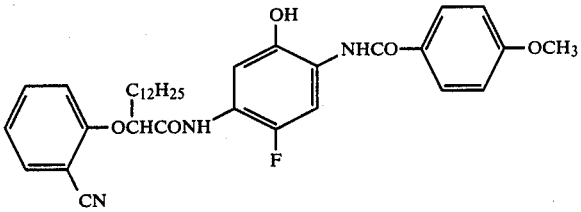
(II-9)
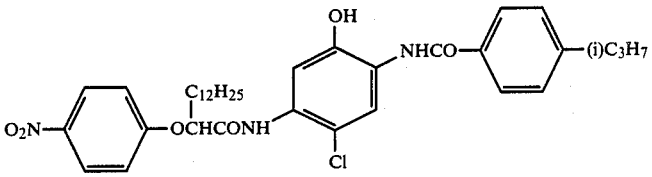
(II-10)
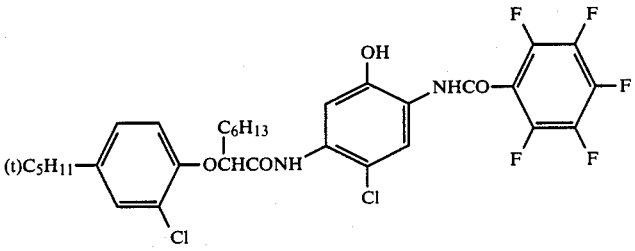

-continued
(II-11)
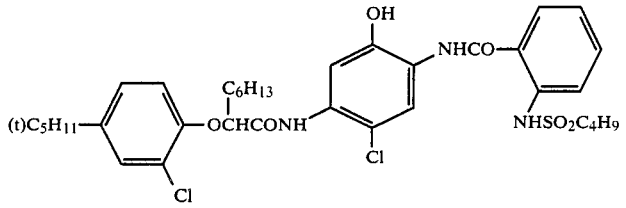
(II-12)
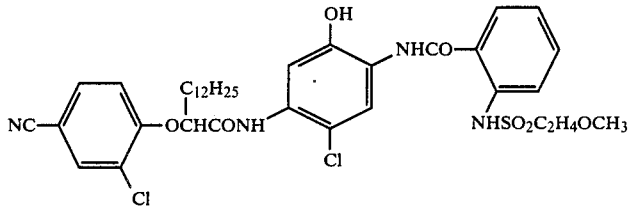
(II-13)
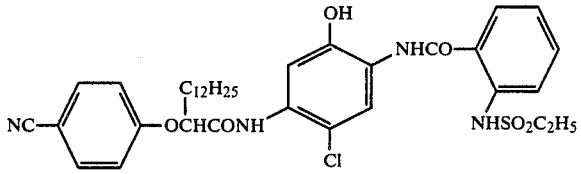
(II-14)
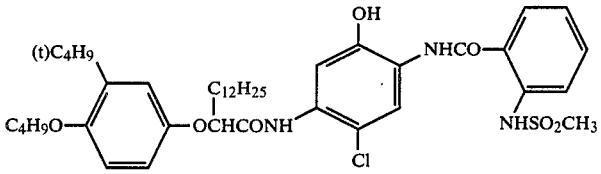
(II-15)
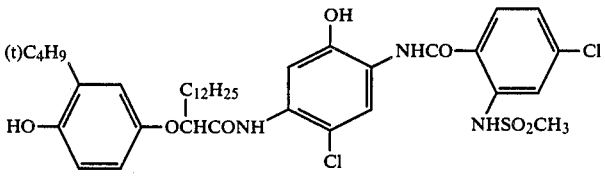
(II-16)
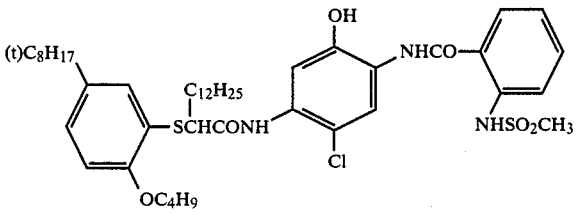
(II-17)
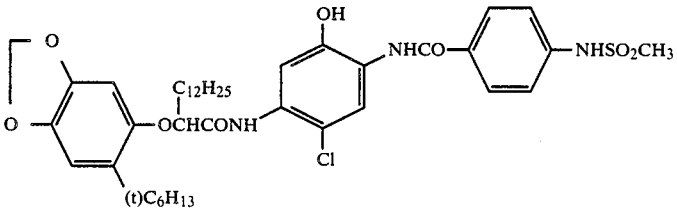

-continued
(II-18)
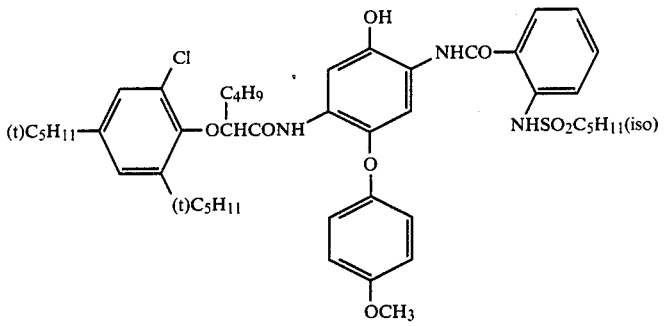
(II-19)
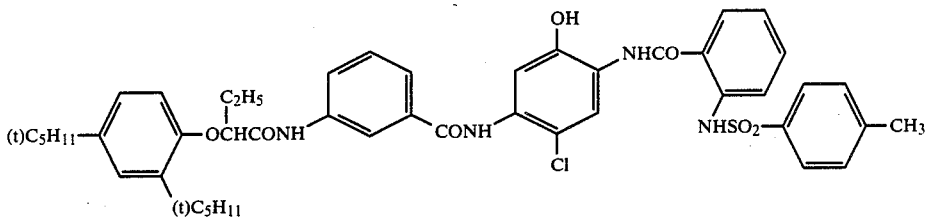
(II-20)
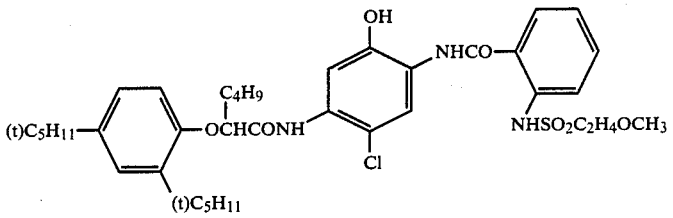
(II-21)
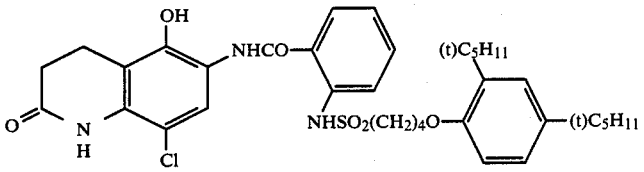
(II-22)
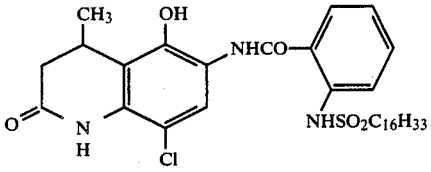
(II-23)
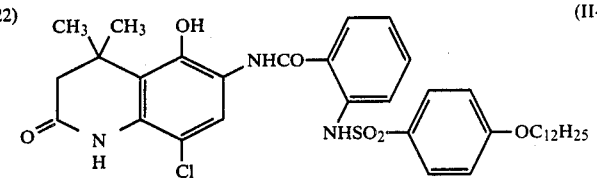
(II-24)
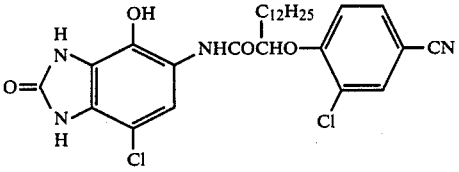
(II-25)
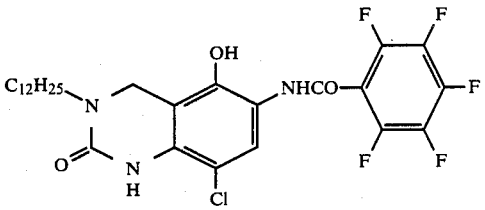
(II-26)
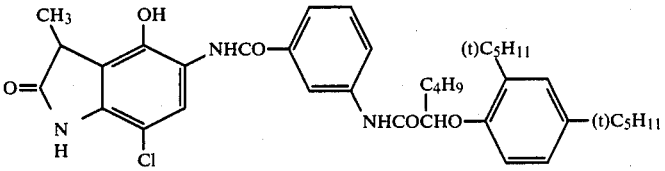

-continued (II-27)

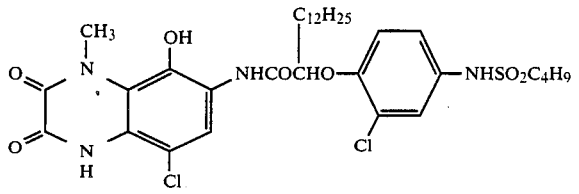

(II-28)

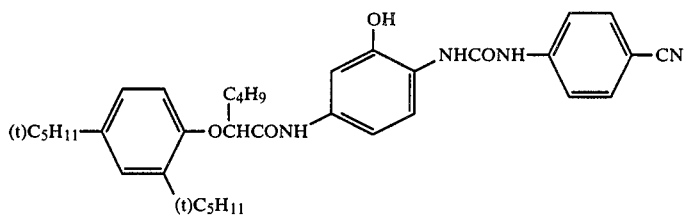

(II-29)

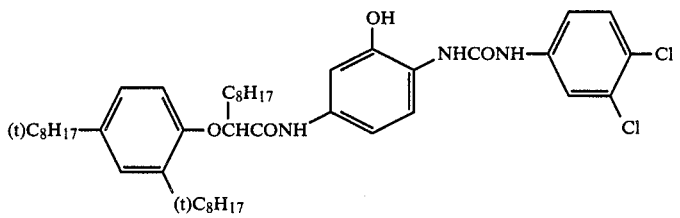

(II-30)

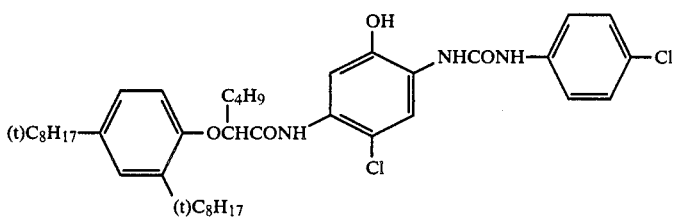

(II-31)

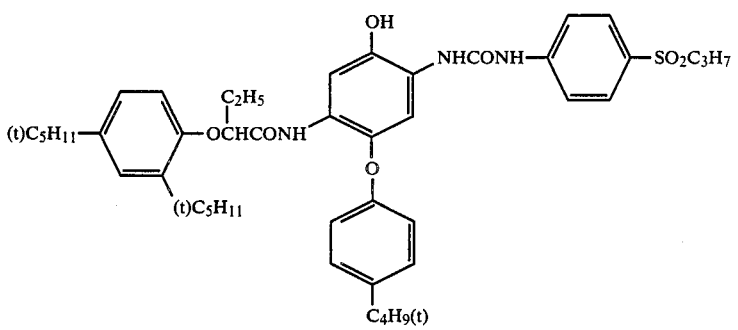

As described before, it is necessary to use at least one organic solvent which is solid at ordinary temperature in the silver halide color photographic material of the present invention. As used herein, the term "ordinary temperature" means about 25° C. The appropriate amount of the organic solvents is not generally limited. The organic solvents are preferably used in a range up to 150 weight % based on the amount of cyan couplers of the present invention, and more preferably in a range from 5 to 80 weight %.

Typical examples of the organic solvents according to the present invention include phthalic acid esters, esters of phosphoric or phosphonic acids, benzoic acid esters, aliphatic carboxylic acid esters and aromatic esters. The objects of the present invention can not be attained when organic solvents having melting points lower than 25° C. are used. The objects of the present invention can be attained only by use of the organic solvents having melting points higher than 25° C.

Specific examples of the organic solvents which are solid at ordinary temperature (i.e., 25° C.) are illustrated below, which, however, should not be construed as limiting the scope of the present invention in any way.

$\bar{O}$-1
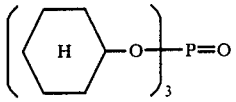
mp. 60° C.
$\bar{O}$-2
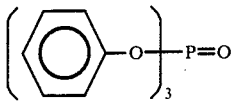
mp. 48.5° C.
$\bar{O}$-3
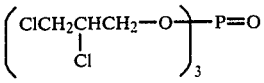
mp. 26.8° C.
$\bar{O}$-4
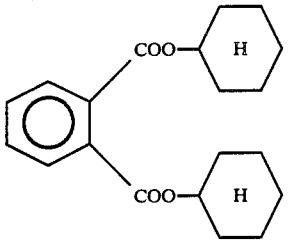
mp. 58–65° C.
$\bar{O}$-5
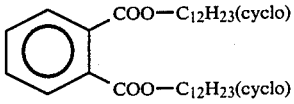
mp. 66–68° C.
$\bar{O}$-6
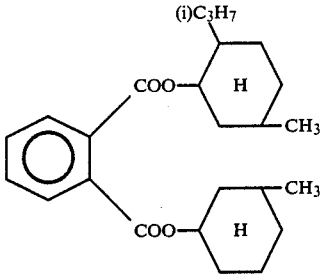
mp. 129–130° C.
$\bar{O}$-7
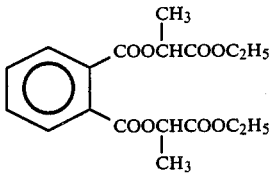
mp. 50–53° C.
$\bar{O}$-8
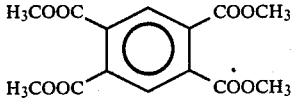
mp. 144–145° C.
$\bar{O}$-9
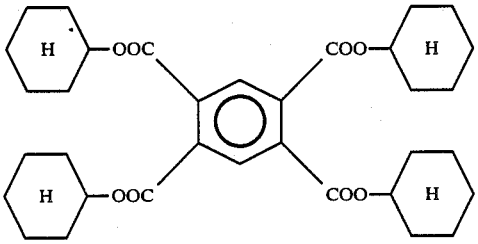
mp. 148–150° C.

-continued $\bar{O}$-10 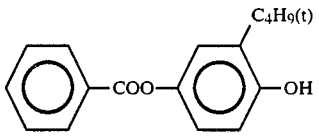

mp. 120–121.5° C.

$\bar{O}$-11 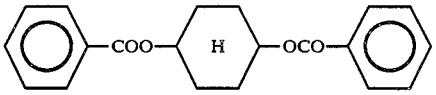

mp. 112.5–115° C.

$\bar{O}$-12 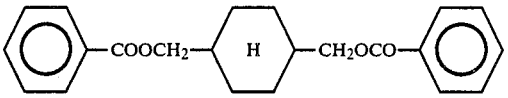

mp. 123.5–126° C.

$\bar{O}$-13 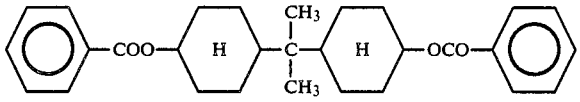

mp. 193–196° C.

$\bar{O}$-14 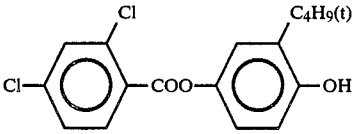

mp. 153–155° C.

$\bar{O}$-15 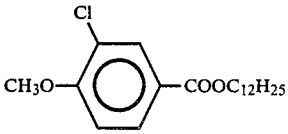

mp. 42.5–43.5° C.

$\bar{O}$-16 $C_{15}H_{31}COOC_{16}H_{33}$ mp. 53–54° C.
$\bar{O}$-17 $C_{15}H_{31}COOC_{18}H_{37}$ mp. 58° C.
$\bar{O}$-18 $(n)C_{17}H_{35}COOCH_3$ mp. 38–39° C.
$\bar{O}$-19 $C_{17}H_{35}COOC_{16}H_{33}$ mp. 58° C.

$\bar{O}$-20 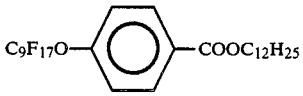

mp. 34.5° C.

$\bar{O}$-21 $CHCOOCH_2(CF_2CF_2)_4H$ ‖ $CHCOOCH_2(CF_2CF_2)_4H$ mp. 44–45° C.

$\bar{O}$-22 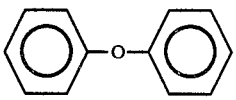

mp. 27° C.

$\bar{O}$-23 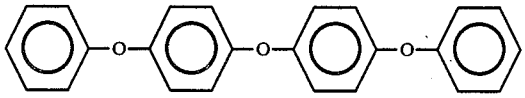

mp. 39–40° C.

$\bar{O}$-24 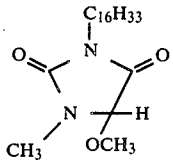

mp. 49–51° C.

Among the compounds represented by formula [III] or [IV], the compounds represented by formula [V] are preferable in view of the effects obtained in the present invention.

[V]

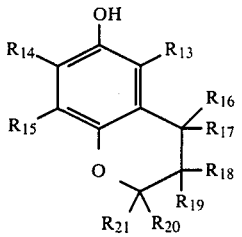

wherein;

$R_{13}$, $R_{14}$ and $R_{15}$ have the same meaning as $R_9$ through $R_{12}$ in formula [IV]; $R_{16}$, $R_{17}$, $R_{18}$, $R_{19}$, $R_{20}$ and $R_{21}$, which may be the same or different, each represents a hydrogen atom, an alkyl, alkenyl, aryl, alkoxy, aryloxy, alkoxycarbonyl, aryloxycarbonyl, amide or hydroxyl group or a halogen atom. Any two groups selected from $R_{16}$ through $R_{21}$ may form a 5- or 6-membered ring.

The compounds represented by formula [VI] are particularly preferred among the compounds of formula [V].

[VI]

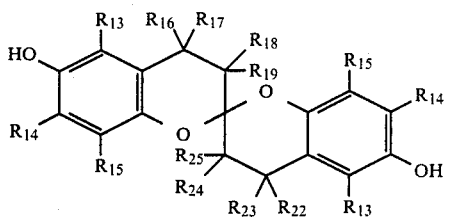

wherein;

$R_{13}$, $R_{14}$ and $R_{15}$ have the same meaning as $R_9$ through $R_{12}$ in formula [III] or [IV], $R_{16}$, $R_{17}$, $R_{18}$ and $R_{19}$ are defined the same as in formula [V]. $R_{22}$, $R_{23}$, $R_{24}$ and $R_{25}$ are defined the same as $R_{16}$ to $R_{19}$.

Specific examples of the compounds represented by formula [III] or [IV] are illustrated below, which, however, should not be construed as limiting the scope of the present invention.

(A-1)

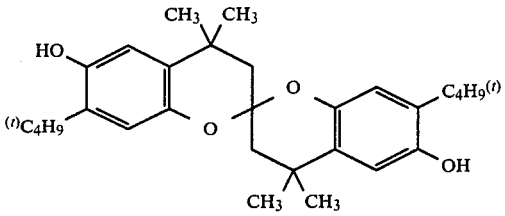

(A-2)

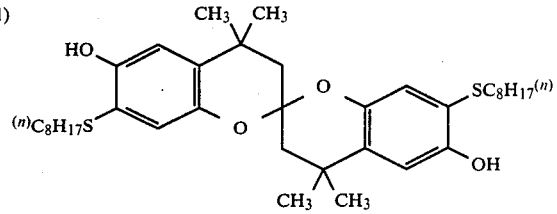

(A-3)

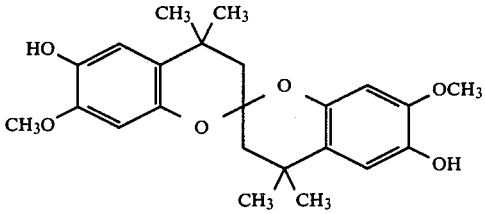

(A-4)

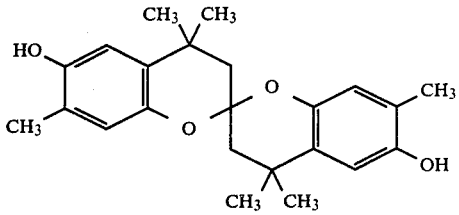

(A-5)

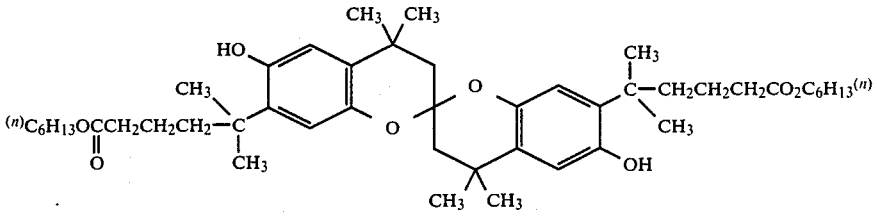

(A-6)

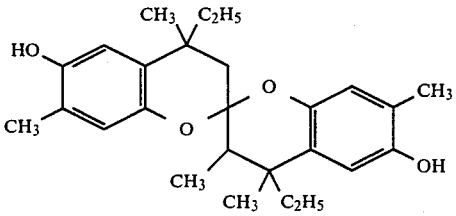

(A-7)

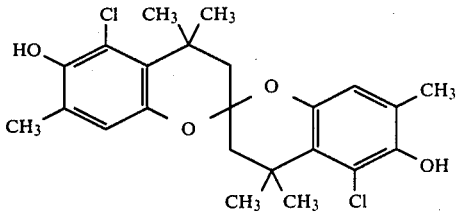

-continued
(A-8)
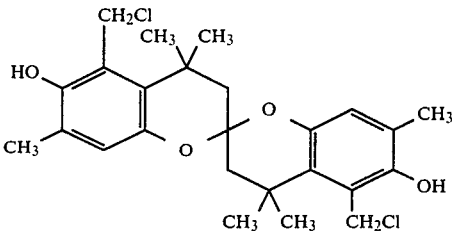
(A-9)
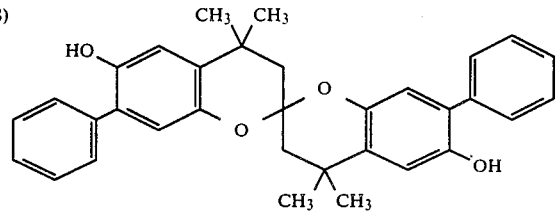
(A-10)
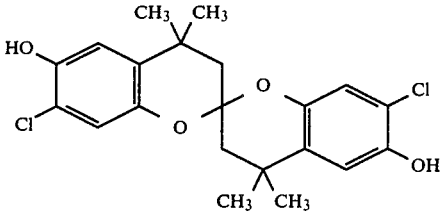
(A-11)
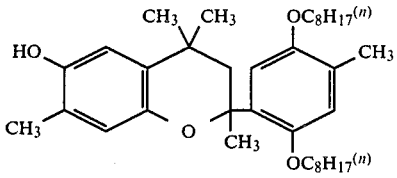
(A-12)
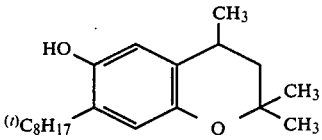
(A-13)
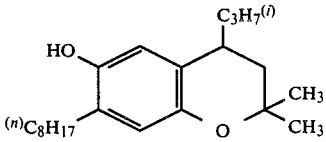
(A-14)
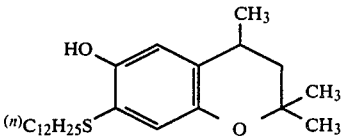
(A-15)
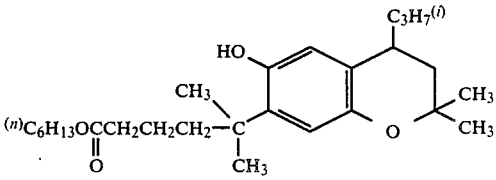
(A-16)
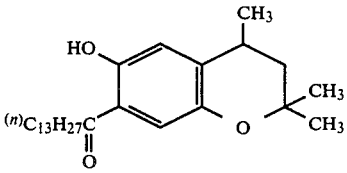
(A-17)
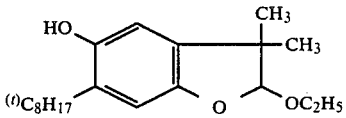
(A-18)
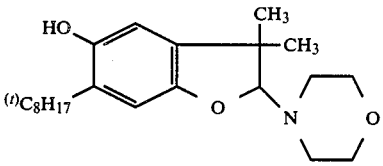
(A-19)
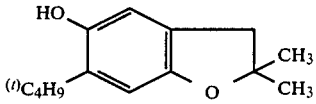
(A-20)
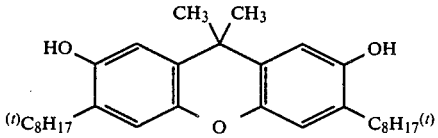
(A-21)
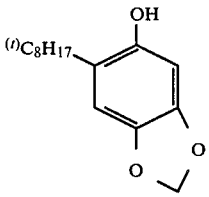
(A-22)
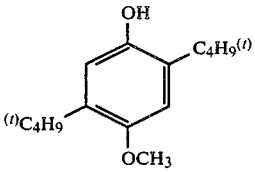
(A-23)
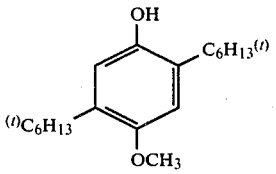

-continued
(A-24)
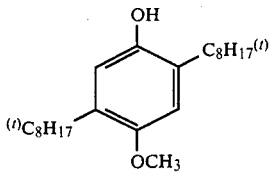
(A-25)
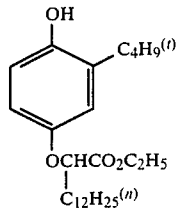
(A-26)
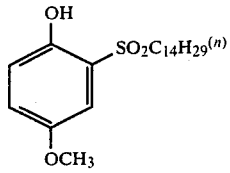
(A-27)
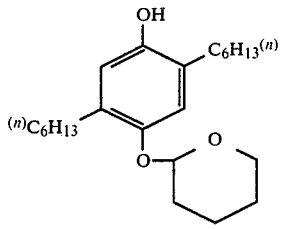
(A-28)
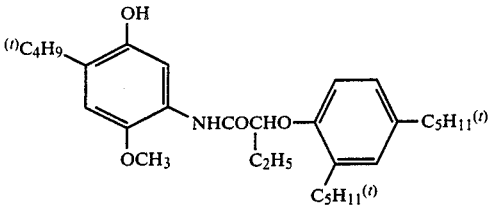
(A-29)
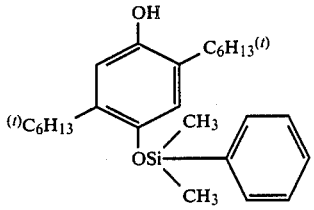
(A-30)
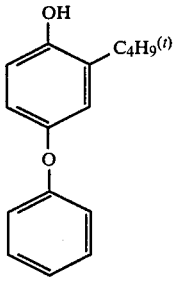
(A-31)
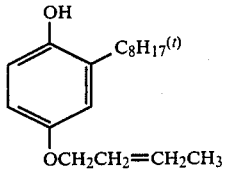
(A-32)
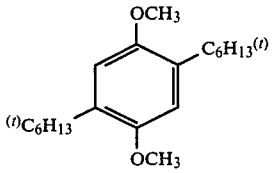
(A-33)
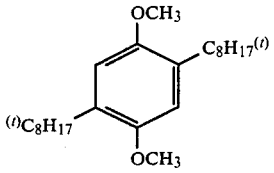
(A-34)
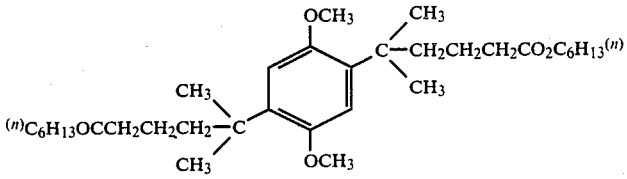
(A-35)
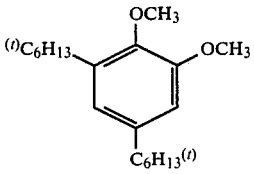
(A-36)
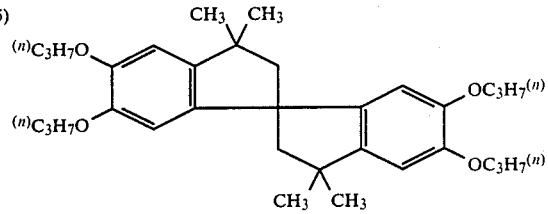
The compounds illustrated above can be synthesized according to the same or similar processes described in U.S. Pat. Nos. 3,764,337, 3,432,300, 3,574,627, 3,573,050, 4,264,720 and 4,273,864, and British Pat. Nos. 1,347,556 and 2,066,975(B) and Japanese Patent Application (OPI) Nos. 56-159644 and 59-10539.
The compounds represented by formulae [III] and [IV] may be added to any silver halide emulsion layer in an amount of 0.005 to 2.0 moles per mol of the cyan couplers and preferably, in an amount of 0.2 to 1.0 mole. The compounds are included preferably in the same silver halide emulsion layer as the cyan couplers.

In combination with the cyan couplers of the present invention, any of known color couplers can be employed. As described herein, the term "color coupler" means compounds capable of forming dyes as a result of a coupling reaction with oxidized aromatic primary amine developers. Useful color couplers are cyan-, magenta- and yellow-color forming-couplers, and typical examples include a compound of the naphthol and phenol type, a compound of the pyrazolone and pyrazoloazole type and a compound of the open-chain or heterocyclic ketomethylene type. Examples of cyan-, magenta- and yellow-color forming couplers which can be employed in the present invention are described in the patents cited in *Research Disclosure,* No. 17643 (December 1978), Section VII-D and *ibid,* No. 18717 (November 1979).

Color-forming couplers for incorporation in the present photographic materials are preferably nondiffusible by being ballasted or polymerized. Two-equivalent couplers having a coupling-off group at the coupling active position are more preferable than four-equivalent couplers having only hydrogen at the coupling position in view of reduced silver coverage. Couplers can be employed in the present invention which form a dye of controlled image smearing or a colorless compound as well as DIR couplers which release a development inhibiting reagent upon coupling reaction and couplers releasing a development accelerating agent.

Representative examples of yellow couplers useful in the present invention include couplers of the "oil-protected" (hydrophobically ballasted) acylacetoamide type, as illustrated in U.S. Pat. Nos. 2,407,210, 2,875,057 and 3,265,506. Typical examples of two-equivalent yellow couplers preferable in the present invention include yellow couplers having an oxygen-linked coupling-off group as illustrated in U.S. Pat. Nos. 3,408,194, 3,447,928, 3,933,501 and 4,022,620; yellow couplers having a nitrogen-linked coupling-off group as illustrated in Japanese Patent Publication No. 58-10739, U.S. Pat. Nos. 4,401,752 and 4,326,024, *Research Disclosure,* No. 18053 (April 1979), British Pat. No. 1,425,020 and German Pat. (OLS) No. 2,219,917, 2,261,361, and 2,433,812. Couplers of the α-pivaloylacetoanilide type are superior in fastness of formed dyed particularly on exposure to light, while couplers of the α-benzoylacetoanilide type are capable of forming high maximum density.

Magenta couplers useful for the present invention include oil-protected couplers of the indazolone or cyanoacetyl type, preferably of the 5-pyrazolone or pyrazoloazole (e.g., pyrazolotriazole) type. 5-Pyrazolones substituted by an arylamino or acylamino group at 3-position are preferable in view of the hue and maximum densities of formed dyes and are illustrated in U.S. Pat. Nos. 2,311,082, 2,343,703, 2,600,788, 2,908,573, 3,062,653, 3,152,896 and 3,936,015. Two-equivalent 5-pyrazolone couplers are preferable since they are capable of providing high image density with less silver coverage, and particularly preferable coupling-off groups thereof are nitrogen-linked coupling-off groups described in U.S. Pat. No. 4,310,619 and an arylthio group described in U.S. Pat. No. 4,351,897. The ballast groups described in European Pat. No. 73,636 have effects to enhance developed density and are useful to couplers of the 5-pyrazolone and pyrazoloazole types. Examples of pyrazoloazole couplers include pyrazolobenzimidazole described in U.S. Pat. No. 3,369,897, more preferably, pyrazolo[5,1-c][1,2,4]triazoles described in U.S. Pat. No. 3,725,067, pyrazolotetrazoles described in *Research Disclosure,* No. 24220 (June 1984) and pyrazolopyrazole described in *Research Disclosure,* No. 24230 (June 1984). Imidazo[1,2-b]pyrazoles described in European Pat. No. 119,741 are preferably and pyrazolo[1,5-b][1,2,4]triazoles described in European Pat. No. 119,860 are particularly preferable with respect to the reduced yellow side-absorption and fastness of developed dyes on exposure to light.

In color negative photographic materials for photographing, colored couplers may be employed in combination with magenta and cyan couplers in order to compensate the unnecessary absorption located at shorter wavelength regions of the developed dyes. Typical examples include yellow-colored couplers as illustrated in U.S. Pat. No. 4,163,670 and Japanese Patent Publication No. 57-39413 and magenta-colored cyan couplers as illustrated in U.S. Pat. Nos. 4,004,929 and 4,138 and British Pat. No. 1,146,368.

The above-mentioned couplers may form dimeric, oligomeric or polymeric couplers. Typical examples of polymer couplers are illustrated in U.S. Pat. Nos. 3,451,820 and 4,080,211. Polymer magenta couplers are described in British Pat. No. 2,102,173 and U.S. Pat. No. 4,367,282.

In order to satisfy the characteristics desired to the photographic materials, various couplers used in the present invention can be employed as a combination of two or more couplers in a light-sensitive layer, or the same compound can be employed in two or more layers.

The cyan couplers of the present invention and other couplers used in combination therewith can be incorporated to photographic materials by various known dispersion techniques. Typically, the cyan couplers may be added according to solid dispersing process, the alkaline dispersing process, preferably, to the latex dispersing process, more preferably, to the oil-in-water dispersing process employing the organic solvent of the present invention. According to the oil-in-water dispersing process, dispersants are first dissolved in a single or mixed solvent of a high-boiling (including solid at 25° C.) organic solvent or a low-boiling (auxiliary) organic solvent, and then dispersed as fine particles in an aqueous medium, e.g., water or an aqueous gelatine solution in the presence of surface active agents. The dispersing process may include the conversion of the dispersed phases and the auxiliary solvent may be removed or reduced by distillation, noodle-washing or ultrafiltration before the use in coating process, if desired.

In the present invention, the aforesaid auxiliary solvents for the solid organic solvents include organic solvents having a boiling point of about 30° C. or higher, preferably, at about 50° C. to 160° C. Typical examples are ethyl acetate, butyl acetate, ethyl propionate, methyl ethyl ketone, cyclohexanone, 2-ethoxyethyl acetate, dimethylformamide, etc.

The process of the latex dispersion, advantages thereof and specific examples of latices useful for the process are described in U.S. Pat. No. 4,199,363, German Patent (OLS) Nos. 2,541,274 and 2,541,230.

The aforementioned color couplers in the present invention, including the cyan couplers represented by formulae [I] and [II], is incorporated in a light-sensitive silver halide emulsion layer, usually in an amount of about 0.001 to 1 mol per mol of silver halide, preferably, in an amount of about 0.001 to 0.5 mol with respect to yellow couplers, in an amount of about 0.003 to 0.3 mol with respect to magenta couplers, and in an amount of about 0.002 to 0.3 mol with respect to cyan couplers.

Silver halide emulsions for use in the present invention can be prepared generally by mixing an aqueous solution of silver salts (e.g., silver nitrate) and an aqueous solution of halides (e.g., potassium bromide, sodium chloride, potassium iodide, alone or in combination thereof) in the presence of water-soluble polymers (e.g., gelatine). Typical examples of silver halides thus prepared are silver chloride, silver bromide and silver mixed halides such as silver chlorobromide, silver chlorobromide and silver bromoiodide. Silver halides for suitable use for the present invention are silver chlorobromoiodides and silver bromoiodides, both containing less than 3 mol % of silver iodide, and silver chlorobromide. Silver halide grains may have internal and external portions different in composition, may have a multiphase structure joined by epitaxial junction, may have a uniform structure, or may comprise a mixture of grains of various crystal forms. With respect to silver chlorobromide having different internal phases, the grains may have nuclei having higher silver bromide content than the average or may have one or more internal structures; the external portions may have silver bromide or silver chloride content higher than the average halide content. The average size of the silver halide grains can be expressed in terms of the grain diameter for spherical or semi-spherical grains and in terms of the edge length for cubic grains, can be determined as the average of the projected area diameter etc., and is preferably smaller than 2 microns and larger than 0.1 microns, and particularly preferably smaller than 1 micron and larger than 0.15 microns.

The distribution of grain size may be either narrow or wide. Monodisperse emulsions may be employed wherein more than 90%, and preferably more than 95%, of the total grain numbers or weight falls within ±40% of the average grain size. In order to realize the gradation desired for the photographic material, two or more monodisperse silver halide emulsions may be mixed in a single layer, or coated as different layers having essentially the same color sensitivity. Further, two or more polydisperse silver halide emulsions or combination of monodisperse and polydisperse emulsions can be employed as mixture in one layer or coated as different layers.

Silver halide grains in the photographic emulsion may have a regular crystal structure such as a cubic, hexahedral, dodecahedral or tetradecahedral structure, an irregular crystal structure such as a spherical structure or a composite crystal structure thereof. Tabular grains may be employed wherein at least 50 percent of the total projected area of silver halide grains is tabular grains having a diameter-to-thickness ratio of about 5 or more, particularly of about 8 or more. Silver halide emulsions may be a mixture of various crystal structures. Silver halide grains may be used which form a latent image primary on the grain surface or those may be used which form a latent image primary in the interior of the grains.

The photographic emulsion for use in the present invention can be prepared by the processes described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsions,* The Focal Press (1964), etc. Any of an acidic process, a neutral process, and an ammoniacal process can be used. As a manner of reacting a soluble silver salt with a soluble halide salt, any of the single jet method, double jet method and a combination thereof may be employed.

A process of forming grains in the presence of excess silver ion (the so-called reversal mixing process) can be employed as well. As one type of the double jet method, the "controlled double jet" process can be employed wherein the pAg in the liquid phase of silver halide formation is kept constant. This process provides a silver halide emulsion containing regular silver halide grains having an approximately monodisperse particle size.

During formation or physical ripening of the silver halide grains, cadmium salts, zinc salts, lead salts, thallium salts, iridium salts or the complex salts thereof, rhodium salts or the complex salts thereof, iron salts or the complex salts thereof, etc., may also be present. After physical ripening, silver halide emulsions are usually subjected to desalting and chemical sensitization for use in coating.

Physical ripening in the presence of silver halide solvents, e.g., ammonia, potassium thiocyanate, thioethers and thiones described in U.S. Pat. No. 3,271,157, Japanese Patent Application (OPI) Nos. 51-12360, 53-82408, 53-144319, 54-100717 and 54-155828 provides silver halide emulsions having regular crystal forms and monodisperse grain size distribution. Removing soluble salts from emulsions before and after physical ripening can be achieved by noodle washing, flocculation precipitation or ultrafiltration, etc.

The silver halide emulsion for the present invention may be subjected to chemical sensitization; sulfur or selen sensitization, reduction sensitization and noble metal sensitization can be employed alone or in combination thereof.

Sulfur sensitization using active gelatine or sulfur-containing compounds capable of reacting with silver (e.g., thiosulfates, thioureas, mercapto compounds, rhodanines, etc.); reduction sensitization using a reductive substance (e.g., stannous salts, amines, hydrazine derivatives, formamidinesulfinic acid, silane compounds, etc.); and noble metal sensitization using noble metal compounds (e.g., complex salts of the Group VIII metals such as Pt, Ir, Pd, etc., as well as gold complex salts) can be employed alone or in combination.

Photographic emulsions in the present invention can be spectrally sensitized with photographic sensitizing dyes. Useful dyes include cyanine dyes, complex cyanine dyes, complex merocyanine dyes, holopolar cyanine dyes, hemicyanine dyes, styryl dyes and hemioxonal dyes. Particularly useful dyes are cyanine dyes, merocyanine dyes and complex merocyanine dyes. In these dyes, any nuclei ordinary used as basic hetero ring in cyanine dyes can be present. Typical nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused an aromatic hydrocarbon ring, i.e., an indolenine nucleus, a benzindolenine nucleus, an indole nucleus, a benzothiazole nucleus, a naphthothiazole nucleus, a benzoselenazole nucleus, a benzimidazole nucleus, a quinoline nucleus, an imidazole[4,5-b]quinozaline nucleus, etc. These nuclei may be substituted with substituents at the nucleus carbon atoms.

In the merocyanine dyes or complex merocyanine dyes, 5- or 6-membered hetero ring nuclei such as a pyrazoline-5-one nucleus, a thiohydantoin nucleus, a 2-thiooxazolidine nucleus, a thiazolidine-2,4-dione nucleus, a rhodanine nucleus, a thiobarbituric acid nucleus, a 2-thioselenazolidine-2,4-dione nucleus, a pyrazolo[1,5-b]benzimidazole nucleus, a pyrazolo[1,5-b]quinazolone nucleus, etc., can be used as ketomethylene structure-containing nuclei.

These sensitizing dyes may be used alone or in combination. A combination of sensitizing dyes is often employed particularly for the purpose of supersensitization.

Together with the sensitizing dye, a supersensitizing substance such as a dye which itself is not sensitizing or a substance which substantially does not absorb visible light may be incorporated in the emulsion. For example, aminostilbene compounds substituted with a nitrogen-containing hetero ring (for example, those described in U.S. Pat. Nos. 2,933,390 and 3,635,721), aromatic acid-formaldehyde condensates (for example, those described in U.S. Pat. No. 3,743,510), cadmium salts, azaindene compounds, etc., may be incorporated. The combinations described in U.S. Pat. Nos. 3,615,613, 3,615,641, 3,617,295 and 3,635,721 are particularly useful.

To the photographic emulsion for use in the present invention, various compounds can be incorporated for the purpose of stabilizing photographic properties and of preventing fog formation during the steps of producing, storing or processing of, photographic materials. Many compounds known as antifoggants or stabilizers can be added; typical examples include azoles, e.g., benzothiazolium salts, benzimidazolium salts, imidazoles, benzimidazoles (preferably 5-nitrobenzimidazole), nitroindazoles, benzotriazoles (preferably 5-methylbenzotriazole), triazoles; mercapto compounds, e.g., mercaptothiazoles, mercaptobenzothiazoles, mercaptobenzimidazoles, mercaptobenzoxazoles, mercaptothiadiazoles, mercaptotriazoles, mercaptotetrazoles (preferably 1-phenyl-5-mercaptotetrazoles, etc.), mercaptopyrimidines, mercaptotriazines, thioketo compounds, e.g., oxazolinethione; azaindenes, e.g., triazaindenes, tetraazaindenes (preferably 4-hydroxy-6-methyl-1,3,3a,7-tetraazaindenes, etc.) benzenethiosulfonic acids, benzenesulfinic acids, benzenesulfonic acid amides; purines, e.g., adenine.

Further detailed examples and their usage of the antifoggants and stabilizers are described in U.S. Pat. Nos. 3,954,474, 3,982,947, Japanese Patent Publication No. 52-28660, *Research Disclosure* No. 17643 (December 1978) VIA-VIM and E. J. Birr, *Stabilization of Photographic Silver Halide Emulsions,* The Focal Press (1974).

The photographic material according to the present invention may contain anticolor-mixing agents such as hydroquinones, aminophenols, amines, gallic acid derivatives, catechols, ascorbic acid derivatives, non-color forming couplers, sulfonamidophenol derivatives.

In the practice of the present invention, compounds having hindered amine and hindered phenol moieties within the same molecule, described in U.S. Pat. No. 4,268,593, are useful for antifading of the yellow-dye images on exposure to heat, humidity and light. In order to prevent fading of magenta dye images, particularly on exposure to light, spiroindanes described in Japanese Patent Application (OPI) No. 56-159644 and chromans substituted by hydroquinone di- or diethers described in Japanese Patent Application (OPI) provide excellent results. The discolor-inhibiting or antifading effects can be achieved by incorporating into light-sensitive layers by co-dispersing these compounds in an amount of 5- to 100 weight percent with corresponding color couplers. In order to prevent fading of cyan-dye-images on exposure to heat, and particularly to light, incorporating ultraviolet light absorbing agents on both layers adjacent to the cyan color forming-layers is useful.

The photographic material of the present invention may contain in its hydrophilic colloidal layer an ultraviolet light absorbent. For example, aryl group-substituted benzotriazoles (e.g., those described in U.S. Pat. Nos. 3,553,794 and 4,236,013, Japanese Patent Publication No. 51-6540 and European Pat. No. 57,160), butadienes (e.g., those described in U.S. Pat. Nos. 4,450,229 and 4,195,999), cinnamic ester compounds (e.g., those described in U.S. Pat. Nos. 3,705,805 and 4,707,375), benzophenones (e.g., those described in U.S. Pat. No. 3,215,530 and British Pat. No. 1,321,355) and high-polymers having ultraviolet light absorbing moieties (e.g., those described in U.S. Pat. Nos. 3,761,272 and 4,431,726). Ultraviolet light absorbing fluorescent whiteners can be used (e.g., those described in U.S. Pat. Nos. 3,499,762 and 3,700,455). Typical examples of ultraviolet light absorbents are described in *Research Disclosure* No. 24239 (June 1984).

The photographic material of the present invention may contain a water-soluble dye as a filter dye or for various purposes such as prevention of irradiation. Examples of preferable dyes include oxonol dyes, hemioxonol dyes, styryl dyes, merocyanine dyes, anthraquinone dyes and azo dyes. In addition, cyanine dyes, azomethine dyes, triarylmethane dyes and phthalocyanine dyes are useful. Oil-soluble dyes can be incorporated in hydrophilic colloidal layers after being emulsified by means of the oil-in-water dispersion method as described in British Pat. No. 1,319,763.

Although gelatine is advantageously used as the binder or protective colloid for the photographic emulsions used in this invention, other hydrophilic colloids may also be used in this invention. For example, proteins such as gelatine derivatives, graft polymers or gelatine with other high polymers, albumin or casein, cellulose derivatives such as hydroxyethyl cellulose, carboxymethyl cellulose or cellulose sulfate, saccharide derivatives such as sodium alginate or starch derivatives, and synthetic hydrophilic high molecular weight materials such as homo- or copolymers, for example, polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole can be used.

As gelatine, acid-processed gelatine or enzyme-processed gelatine as described in *Bull. Soc. Sci. Photogr. Japan,* No. 16, p. 30 (1966) may be used as well as lime-processed gelatine, and a gelatine hydrolyzate or an enzyme-decomposed product can be used.

The photographic material of the present invention can contain inorganic or organic gelatine hardeners in any of the hydrophilic colloidal layers forming photographic or backing layers.

The photographic material of the present invention may contain one or more surfactants for the purpose of coating aids, antistatic agents, slipping aids, emulsifying or dispersing aids, adhesion prevention, photographic characteristics improvement (e.g., development acceleration, high gradation, sensitivity increase), etc.

To the photographic material of the present invention, in addition to the above described additives, may be added various photographic additives such as stabilizers, stain preventing agents, developers or precursors thereof, lubricating agents, mordants, antistatic agents, plasticizers, examples of which are described in *Research Disclosure,* Nos. 17643 (December, 1978) and 18716 (November, 1979).

The present invention may also be applied to a multilayered, multicolor photographic material comprising a support having thereon at least two layers with different spectral sensitivities. Multilayered natural color photographic materials usually comprise a support having thereon at least one red-sensitive emulsion layer, and at least one blue-sensitive emulsion layer. The order of these layers may be optionally selected as the case demands. The preferred layer arrangements are red-sensitive, green-sensitive and blue-sensitive layers in this order from the support, blue-sensitive, red-sensitive and green-sensitive layers or blue-sensitive, green-sensitive and red-sensitive layers in this order also from the support. Each emulsion layer of these arrangements may be composed of two or more sublayers of different sensitivities and a non-sensitive layer may be present between two or more layers of the same spectral sensitivity. The red-sensitive emulsion layer usually contains a cyan dye forming coupler, the green-sensitive emulsion layer a magenta dye forming coupler and the blue-sensitive emulsion layer a yellow dye forming coupler. However, in some cases, different combinations may be employed.

The photographic material according to the present invention may have auxiliary layers such as protective layers, intermediate layers, filter layers, antihalation layers, backing layers, etc., if necessary, in addition to silver halide emulsion layers.

The photographic emulsion layer of the present invention forming the dye image is coated on a flexible support such as a synthetic resin film, paper or cloth usually used for photographic materials, or on a rigid support such as glass, earthenware, metal, etc. Useful flexible supports include films composed of semisynthetic or synthetic high polymers such as cellulose nitrate, cellulose acetate butyrate, polystyrene, polyethylene terephthalate, polycarbonate, etc., and papers coated or laminated with a baryta layer or an $\alpha$-olefin polymer (for example, polyethylene, polypropylene, ethylene-butene copolymer, etc.). The support may be colored with a dye or a pigment, or may be blackened for intercepting light. The surface of the support is generally subbed for improving adhesion to a photographic emulsion layer or the like. The support surface may be subjected to a corona discharge treatment, a UV light irradiation, or a flame treatment before or after the subbing treatment.

For coating photographic emulsion layers and other hydrophilic colloidal layers, various known coating method can be employed such as the dip coating method, the roller coating method, the curtain coating method, the extrusion coating method, etc. Multilayers can be coated at one time according to the coating methods described in U.S. Pat. Nos. 2,681,294, 2,761,791, 3,526,528 and 3,508,947.

Color developers for development-treating the photographic materials of the present invention generally comprise an alkaline aqueous solution containing an aromatic primary amine developing agent. Suitable color developing agents include known aminophenols and preferably p-phenylenediamines (e.g., 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and their salts between sulfuric acid, hydrochloric acid or p-toluenesulfuric acid, etc.).

The color developer may further contain pH buffers such as alkali metal carbonates, borates or phosphates, development inhibitors or antifogging agents such as bromides, iodides, and organic antifogging agents (e.g., benzimidazoles, benzothiazoles, mercapto compounds), and, if necessary, a water softener, a preservative (e.g., hydroxylamine, sulfites), an organic solvent (e.g., triethanolamine, diethylene glycol), a development accelerator (e.g., benzyl alcohol, polyethylene glycol, a quaternary ammonium salt, an amine), a dye forming coupler, a competitive coupler, a fogging agent (e.g., sodium borohydride), an auxiliary development agent (e.g., 1-phenyl-3-pyrazolidone), a viscosity imparting agent, a chelating agent (e.g., aminopolycarboxylic acids, aminopolyphosphoric acids, alkylphosphoric acids, phosphonocarboxylic acids), an antioxidant described in German Pat. (OLS) No. 2,622,950.

In the development treatment of a reversal color photographic material, the color development is carried out after black-and-white development. The black-and-white developers may contain any of known black-and-white developing agents such as dihydroxybenzenes (e.g., hydroquinone), 3-pyrazolidones (e.g., 1-phenyl-3-pyrazolidone) or aminophenols, alone or in combination.

Color developed photographic emulsion layers are usually bleached. Bleaching may be conducted separately or simultaneously with fixing. Compounds of polyvalent metals such as iron (III), cobalt (III), chromium (III), copper (II), etc., peracids, quinones, nitroso compounds, etc., can be used as bleaching agents. Typical examples of useful bleaching agents include ferricyanates, dichromates, organic complex salts of iron (III) or cobalt (III) such as complex salts with an aminopolycarboxylic acid (e.g., ethylenediaminetetraacetic acid, diethylenetriaminepentaacetic acid, nitrilotriacetic acid, 1,3-diamino-2-propanoltetraacetic acid, etc.) or an organic acid (e.g., citric acid, tartaric acid, maleic acid, etc.); persulfates, permanganates; nitrosophenol; etc., may be used. Of these, potassium ferricyanate, iron (III) sodium ethylenediaminetetraacetate, and iron (III) ammonium ethylenediaminetetraacetate are particularly useful from the view points of rapid treatment and less environmental pollution. Iron (III) ethylenediaminetetraacetates are useful in both an independent bleaching solution and a monobath bleach-fixing solution.

In a bleaching solution or a bleach-fixing solution, various accelerators can be used if necessary. Compounds releasing bromide ions or iodide ions; compounds of the thiourea type illustrated in U.S. Pat. No. 3,706,561, Japanese Patent Publication Nos. 45-8506 and 49-36586, Japanese Patent Application (OPI) Nos. 53-32735, 53-36233 and 53-37016; compounds of the thiol type illustrated in Japanese Patent Application (OPI) Nos. 53-124424, 53-95631, 53-32736 and 54-52532 and U.S. Pat. No. 3,893,858; heterocyclic compounds illustrated in Japanese Patent Application (OPI) Nos.

49-59644, 50-140129, 53-28426, 53-141623, 53-104232 and 54-35727; compounds of the thioether type illustrated in Japanese Patent Application (OPI) Nos. 52-20832, 55-25064 and 55-26506; tertiary amines described in Japanese Patent Application (OPI); thiocarbamoyls described in Japanese Patent Application (OPI) No. 49-42349, can be used alone or in combination. Bromide or iodide ion-releasing compounds, thiols or disulfides are preferable fixing accelerators. These are particularly useful when used for bleach-fixing color photographic materials for photographing.

As fixing agents, thiosulfates, thiocyanates, thioethers, thioureas, etc., can be used; thiosulfates are generally used. As preservatives for bleach-fixing or fixing solutions, sulfites, bisulfites or carbonyl bisulfite addition compounds are preferable.

The photographic materials under processing may be washed after color development or bleach-fixing. Washing time after desilvering is usually within 3 minutes and can be shortened to less than 1 minute by means of a stabilizing bath or waterless washing.

Color developing agents can be incorporated into the silver halide color photographic materials of the present invention in view of the simplified or accelerated processing. Various precursors of the color developing agents are preferable for the incorporation. Useful are compounds of the indoaniline type described in U.S. Pat. No. 3,342,597; compounds of the Schiff base type illustrated in U.S. Pat. No. 3,342,599, Research Disclosure Nos. 14850 and 15159; compounds of the Aldol type described in Research Disclosure No. 13924; metal complexes described in U.S. Pat. No. 3,719,492; compounds of the urethane type described in Japanese Patent Application (OPI) 53-135628; and various precursors of the salt type illustrated in Japanese Patent Application (OPI) Nos. 56-6235, 56-16133, 56-59232, 56-67842, 56-83734, 56-83735, 56-83736, 56-89735, 56-83736, 56-89735, 56-81837, 56-54430, 56-106241, 56-107236, 57-97531 and 57-83565.

The silver halide color photographic material of the present invention may contain various 1-phenyl-3-pyrazolidones, if necessary, in order to accelerate the color development. Typical examples thereof are described in Japanese Patent Application (OPI) Nos. 56-64339, 57-144547, 57-211147, 58-50532, 58-50536, 58-50533, 58-50534, 58-50535, and 58-115438.

Various development processing baths useful for the present invention are used at a temperature range of 10° C. to 50° C. The temperature range of 33° C. to 38° C. is generally employed; higher temperatures enable accelerated processing of shortened processing time; lower temperatures can be employed in view of improved picture quality and improved stabilities of the processing liquids. Image enhancement processing by means of cobalt compounds or hydrogen peroxide described in German Pat. No. 2,26,700 or U.S. Pat. No. 3,674,499 can be employed to process the photographic materials having less silver halides.

Various types of processing baths useful for the present invention may be equipped with heaters, temperature sensors, liquid surface sensors, circulating pumps, filters, floating covers, squeegees, etc.

Developed dyes are deteriorated and faded by fungi during storage as well as by light, heat or humidity. Cyan color images in particular are deteriorated by fungi, and hence the use of antifungal agents is preferable. Specific examples of the antifungal agents include 2-thiazolylbenzimidazoles as described in Japanese Patent Application (OPI) No. 57-157244. The antifungal agents may be incorporated in photographic materials, added to a solution in development processing, or applied to the processed photographic materials at any step.

The silver halide color photographic materials of the present invention possess good color forming properties and provides a color photographic image with good reproducibility and improved image preservability and, particularly, undergoes no significant change in color balance for a long period of time both on exposure to light and in the dark. The silver halide photographic materials provide a color image with good preservability that does not lose color balance, not only in highly colored areas but also in gradation areas when stored for a long time under relatively mild temperature range or humidity, or both.

The silver halide color photographic material of the present invention provides a color image with improved preservability on exposure to humid heat and improved fastness on exposure to light.

The present invention will now be illustrated in greater detail with reference to the following examples, but it should be understood that these examples are not limiting the present invention.

EXAMPLE 1

The mixture of 25 g ($5.05\times10^{-2}$ mol) of Coupler A, 15 g of Coupler Solvent (1) (0.6 of weight ratio to the coupler), 9.3 g of Discoloration Inhibitor (101) (0.5 of mole ratio to the coupler) and 50 ml of ethyl acetate was heated to 50° C. and the resulting mixture was added with stirring to 250 ml of an aqueous solution containing 25 g of gelatine and 1.0 g of sodium dodecylbenzenesulfonate. The entire mixture was emulsified into fine particles by pushing through a preheated colloidmill five times.

The resulting entire emulsion was added to 1.0 kg of a photographic emulsion containing 54 g of silver chlorobromide emulsion (bromide content: 50 mol %) and 60 g of gelatine. After addition of 80 ml of a 2 wt % aqueous solution of 4,6-dichloro-2-hydroxytriazine as a hardener, the pH of the mixture was adjusted to 6.0. The mixture was coated on a cellulose triacetate film support so as to form a layer of 7.0 micron as a dry thickness. The resulting sample was designated as Sample A.

The same procedure as described above was repeated except that the coupler dispersion was prepared by using equal weights of Coupler Solvents (2) or (3) or comparative Coupler Solvent (11) instead of Coupler Solvent (1). The resulting Sample were designated as Sample B, C and P. Further, the same procedure as described above was repeated except that the coupler dispersion was prepared by equal moles of Discoloration Inhibitors (102) or (103) or comparative Discoloration Inhibitor (111) in place of Discoloration Inhibitor (101). The resulting samples were designated as Samples D, E and Q. The sample R was prepared similarly as Sample A except that no Discoloration Inhibitor was incorporated.

The same procedure as described with regard to Sample A was repeated except that Coupler (A) was replaced with equal moles of Coupler (B) or half moles of Couplers (A) and (C). The resulting samples were designated as Samples F and G.

The couplers and coupler solvents used are as follows:

Coupler (A): illustrated compound (I-1)
Coupler (B): illustrated compound (I-2)
Coupler (C): illustrated compound (II-5)
Coupler Solvent (1): illustrated compound ($\bar{O}$-1), Mp 60° C.
Coupler Solvent (2): illustrated compound ($\bar{O}$-2), Mp 50° C.
Coupler Solvent (3): illustrated compound ($\bar{O}$-4), Mp 48.5° C.
Coupler Solvent (11): tri-iso-nonyl phosphate, liquid at 25° C.

Discoloration Inhibitor (101)
[Illustrated Compound A-4]

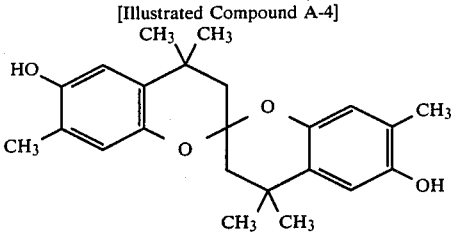

Discoloration Inhibitor (102)
[Illustrated Compound A-36]

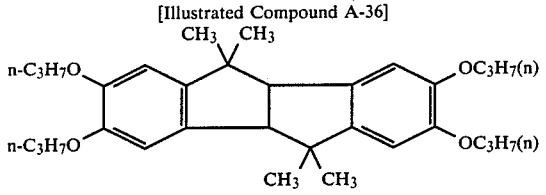

Discoloration Inhibitor (103)
[Illustrated Compound A-12]

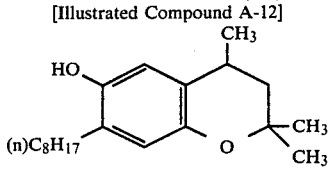

Discoloration Inhibitor (111)

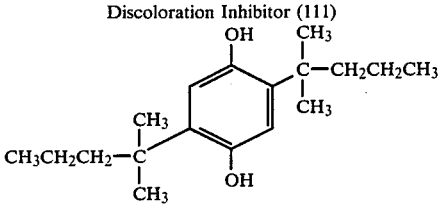

Each of the above samples was gradation exposed through a sensitometric optical wedge and then subjected to the following development processing: Color Development Processing:

| Processing Step | Temperature (°C.) | Time |
|---|---|---|
| Development | 33 | 3 min 30 sec |
| Bleach-fixing | 33 | 1 min 30 sec |
| Washing with water | 28–35 | 3 min |

Formulations of the processing solutions used were as follows.

| | |
|---|---|
| Developer | |
| Benzyl alcohol | 15 ml |
| Diethylene glycol | 8 ml |
| Disodium ethylenediaminetetraacetate | 5 g |
| Sodium sulfite | 2 g |
| Potassium carbonate, anhydrous | 30 g |
| Hydroxylamine sulfuric acid salt | 3 g |
| Potassium bromide | 0.6 g |
| 4-Amino-N—ethyl-N—(β-methanesulfonamido-ethyl)-m-toluidine ⅔ sulfate monohydrate | 5 g |
| Water to make | 1,000 ml |
| pH adjusted to | 10.2 |
| Bleach-fixing Solution | |
| Disodium ethylenediaminetetraacetate | 2 g |
| Ferric ethylenediaminetetraacetate | 40 g |
| Sodium sulfite | 5 g |
| Ammonium thiosulfate | 70 g |
| Water to make | 1,000 ml |
| pH adjusted to | 6.8 |

Each of the thus processed samples was subjected to a color fading test under the following conditions. This evaluation is different from the conventional heat fastness test, as described in U.S. Pat. No. 4,455,367, wherein the fastness is compared after several days of storage at 100° C. in the dark. According to the present method, a series of accelerated heat fastness tests were carried out at elevated temperatures (e.g., at 10° C. intervals). These results were extrapolated at room temperature by the Arrhenius' equation in order to evaluate the lifetime at the room temperature. Table 1 shows the days necessary for the initial cyan density of 1.0 to decrease to densities of 0.8 or 0.5 at different temperatures (40% RH).

Based on the results obtained above, the Arrhenius plot anaylses (the days on a log scale as the axis of ordinate vs the inverse of absolute temperature as the axis of abscissa; extrapolated to 25° C. by the least-squares method) gave the lifetimes at 25° C. shown in Table 2.

The results have shown that Samples A to G of this invention have lifetimes 2 to 6 times longer than comparative Samples P, Q and R at 25° C., 40 percent relative humidity.

TABLE 1

| | Temperature (°C.) | | | | | | | | | |
|---|---|---|---|---|---|---|---|---|---|---|
| | 90 | | 80 | | 70 | | 60 | | 50 | |
| | Cyan density after heating | | | | | | | | | |
| Sample | 0.8 | 0.5 | 0.8 | 0.5 | 0.8 | 0.5 | 0.8 | 0.5 | 0.8 | 0.5 |
| A | 5.8 | 17.5 | 21 | 71 | 60 | 240 | 240 | 830 | 860 | >1000 |
| B | 6.5 | 17.9 | 25 | 74 | 68 | 182 | 260 | 620 | 940 | >1000 |
| C | 4.1 | 14.0 | 17.8 | 60 | 54 | 135 | 230 | 530 | 820 | >1000 |
| D | 5.2 | 14.7 | 19.4 | 58 | 57 | 150 | 210 | 470 | 670 | >1000 |
| E | 5.5 | 15.5 | 22 | 63 | 66 | 160 | 270 | 510 | 920 | >1000 |
| F | 9.9 | 31.0 | 30 | 95 | 99 | 310 | 360 | >1000 | >1000 | >1000 |
| G | 10.9 | 31.4 | 31 | 95 | 93 | 290 | 320 | 1000 | 1000 | >1000 |
| P | 4.1 | 13.4 | 16.3 | 45 | 42 | 105 | 117 | 290 | 430 | 990 |
| Q | 4.5 | 12.3 | 14.7 | 43 | 39 | 98 | 114 | 270 | 400 | 1000 |

TABLE 1-continued

| | Temperature (°C.) | | | | | | | | | |
|---|---|---|---|---|---|---|---|---|---|---|
| | 90 | | 80 | | 70 | | 60 | | 50 | |
| | Cyan density after heating | | | | | | | | | |
| Sample | 0.8 | 0.5 | 0.8 | 0.5 | 0.8 | 0.5 | 0.8 | 0.5 | 0.8 | 0.5 |
| R | 4.9 | 13.0 | 14.5 | 38 | 40 | 95 | 138 | 290 | 400 | 950 |

TABLE 2

| Sample | Density after lapse of time for the initial cyan density 0.8 | 0.5 |
|---|---|---|
| A | ~100 years | ~400 years |
| B | ~100 | ~200 |
| C | ~100 | ~200 |
| D | ~70 | ~150 |
| E | ~100 | ~150 |
| F | ~150 | ~500 |
| G | ~100 | ~400 |
| P | ~30 | ~70 |
| Q | ~30 | ~70 |
| R | ~30 | ~70 |

EXAMPLE 2

On a paper support, both surfaces of which are laminated with polyethylene, were coated a first layer (undermost layer) to a seventh layer (uppermost layer) as shown below, in order to prepare a multilayer color photographic light-sensitive material, Sample S.

| Layer | Main Composition | |
|---|---|---|
| Seventy Layer (Protective layer) | Gelatin | 1.62 g/m$^2$ |
| Sixth Layer (Ultraviolet light-absorbing layer) | Gelatin | 1.06 g/m$^2$ |
| | Ultraviolet Light Absorbing Agent (*1) | 0.35 g/m$^2$ |
| | Ultraviolet Light Absorbing Agent (*2) | 0.12 g/m$^2$ |
| Fifth Layer (Red-sensitive layer) | Silver Chlorobromide Emulsion (silver bromide: 50 mol %) | 0.25 g/m$^2$ (as silver) |
| | Gelatin | 1.26 g/m$^2$ |
| | Cyan Coupler (*3) | 0.50 g/m$^2$ |
| | Coupler Solvent (*2) | 0.25 g/m$^2$ |
| Fourth Layer (Ultraviolet light absorbing layer) | Gelatin | 1.60 g/m$^2$ |
| | Ultraviolet Light Absorbing Agent (*1) | 0.70 g/m$^2$ |
| | Color Mixing Preventing Agent (*4) | 0.20 g/m$^2$ |
| | Color Mixing Preventing Agent Solvent (*2) | 0.30 g/m$^2$ |
| Third Layer (Green-sensitive layer) | Silver Chlorobromide Emulsion (silver bromide: 70 mol %) | 0.17 g/m$^2$ (as silver) |
| | Gelatin | 1.40 g/m$^2$ |
| | Magenta Coupler (*5) | 0.40 g/m$^2$ |
| | Coupler Solvent (*6) | 0.20 g/m$^2$ |
| Second Layer (Intermediate layer) | Gelatin | 1.10 g/m$^2$ |
| | Color Mixing Preventing Agent (*4) | 0.20 g/m$^2$ |
| | Color Mixing Preventing Agent Solvent (*2) | 0.10 g/m$^2$ |
| First Layer (Blue-sensitive layer) | Silver Chlorobromide Emulsion (silver bromide: 80 mol %) | 0.35 g/m$^2$ (as silver) |
| | Gelatin | 1.54 g/m$^2$ |
| | Yellow Coupler (*7) | 0.50 g/m$^2$ |
| | Coupler Solvent (*2) | 0.50 g/m$^2$ |
| Support | Polyethylene laminated paper (the polyethylene coating containing a white pigment ($TiO_2$, etc.) and a bluish dye (ultramarine, etc.) at the first layer side). | |

-continued

The compounds used in the above layers were as follows:

(*1) 2-(2-Hydroxy-3-sec-butyl-5-tert-butylphenyl) benzotriazole (*2) Dibutyl phthalate (*3)

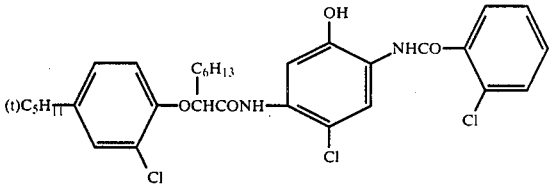

(*4) 2,5-Di-tert-octylhydroquinone (*5)

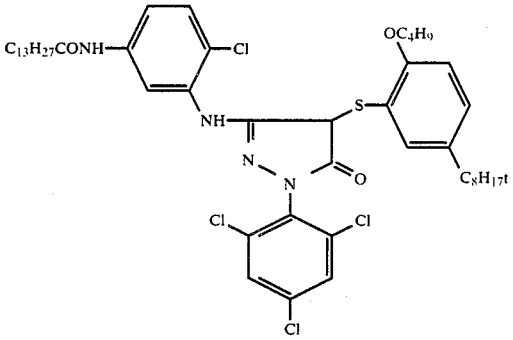

(*6) Trioctyl phosphate (*7) α-Pivaloyl-α-(2,4-dioxo-5,5-dimethyloxazolidin-3-yl)-2-chloro-5-[α-(2,4-di-tert-amylphenoxy)-butanamido]-acetanilide In addition, 1-oxy-3,5-dichloro-s-triazine sodium salt was added to each layer during preparation as a gelatin hardening agent.

Samples T to Z are prepared in the same manner as in Sample S except that the following cyan coupler, coupler solvent and discoloration inhibitor as shown in Table 3 were used in fifth layer. In each Samples U–Z, per 1 mol of cyan coupler, 0.5 mol of discoloration inhibitor is employed.

TABLE 3

| Sample | Cyan coupler | Coupler solvent | Discoloration inhibition |
|---|---|---|---|
| T | Exemplified compound I-1 | Exemplified compound O-1 | — |
| U | Exemplified compound I-1 | Exemplified compound O-1 | Exemplified compound A-1 |
| V | Exemplified compound I-2 | Exemplified compound O-1 | Exemplified compound A-1 |
| W | Exemplified compound I-2 | Exemplified compound O-2 | Exemplified compound A-1 |
| X | Exemplified compound I-2 | Exemplified compound O-2 | Exemplified compound A-4 |
| Y | Exemplified compound I-1/II-5 (molar ratio 1/1) | Exemplified compound O-1 | Exemplified compound A-4 |
| Z | Exemplified compound I-1/II-5 (molar ratio 1/1) | Exemplified compound O-1 | Exemplified compound A-1 |

The photographic light-sensitive material thus prepared as Samples S to Z were imagewise exposed to light and subjected to continuous processing according to the processing steps as shown below using a Fuji Color Roll Processor FMPP-1000 (manufactured by Fuji Photo Film Co., Ltd.).

The washing with water steps were carried out by a three-step countercurrent water washing process from washing with water (3) to washing with water (1).

Further, the amount of processing solution carried over into each tank from the preceding tank was about 60 ml per $m^2$ of the photographic light-sensitive material processed in each step from the bleach-fixing step to the washing with water step (3).

The condition of the color development step was the same in whole cases, and the amount of replenisher was 161 ml per $m^2$ of the color paper processed.

The composition of each tank solution and replenisher used in the above described procvessing was as follows.

| | Tank Solution | Replenisher |
|---|---|---|
| Color Developing Solution | | |
| Water | 800 ml | 800 ml |
| Trisodium nitrilotriacetate | 2.0 g | 2.0 g |
| Benzyl alcohol | 14 ml | 18 ml |
| Diethylene glycol | 10 ml | 10 ml |
| Sodium sulfite | 2.0 g | 2.5 g |
| Hydroxylamine sulfate | 3.0 g | 3.5 g |
| Potassium bromide | 1.0 g | — |
| Sodium carbonate | 30 g | 35 g |
| N—Ethyl-N—(β-methanesulfonamidoethyl)-3-methyl-4-aminoaniline sulfate | 5.0 g | 8.0 g |
| Water to make | 1000 ml (pH 10.15) | 1000 ml (pH 10.65) |
| Bleach-Fixing Solution | | |
| Water | 400 ml | 400 ml |
| Ammonium thiosulfate (70% soln.) | 150 ml | 300 ml |
| Sodium sulfite | 18 g | 36 g |
| Ammonium ethylenediaminetetraacetate iron (III) | 55 g | 110 g |
| Disodium ethylenediaminetetraacetate | 5 g | 10 g |
| Water to make | 1000 ml (pH 6.70) | 1000 ml (pH 6.50) |

Under the above described conditions, the color papers were processed at 5 $m^2$ per day for 120 days.

Each of sample after being exposed continuously through an wedge for sensitomery was subjected to development processing using the processor above stated. Processed samples were preserved at 60° C. in 40% RH for 100 or 200 days and then examined for fastness to heat in the dark by measuring residual density with respect to an image having initial denseity of 1.0.

The results are shown in Table 4.

TABLE 4

| | 60° C.-40% RH 100 days | | | 60° C.-40% RH 200 day | | |
|---|---|---|---|---|---|---|
| Sample | Yellow | Magenta | Cyan | Yellow | Magenta | Cyan |
| S | 0.95 | 0.98 | 0.82 | 0.93 | 0.96 | 0.66 |
| T | 0.95 | 0.99 | 0.84 | 0.92 | 0.97 | 0.68 |
| U | 0.96 | 0.98 | 0.89 | 0.92 | 0.96 | 0.83 |
| V | 0.94 | 0.99 | 0.92 | 0.92 | 0.96 | 0.85 |
| W | 0.95 | 0.99 | 0.91 | 0.91 | 0.97 | 0.83 |
| X | 0.95 | 0.98 | 0.90 | 0.93 | 0.97 | 0.84 |
| Y | 0.94 | 0.99 | 0.88 | 0.91 | 0.97 | 0.82 |
| Z | 0.96 | 0.98 | 0.88 | 0.93 | 0.96 | 0.83 |

As is apparent from the results in Table 4, Comparative Samples S and T show remarkable reduction in cyan density, resulting in significant change in color balance to reddish side. Contrary to the above, Samples U to Z of the present invention, in spite of the reduction in cyan density, undergoes no significant change in color balance.

As many apparently widely different embodiments of this invention may be made without departing from the spirit and scope thereof, it is to be understood that the invention is not limited to the specific embodiments thereof except as defined in the appended claims.

What is claimed is:

1. A color photographic material which comprises a support having thereon at least one silver halide emulsion layer having associated therewith at least one cyan dye forming coupler represented by formula [I], at least one coupler solvent having a melting point higher than 25° C., and at least one compound represented by formula [VI]:

[I]

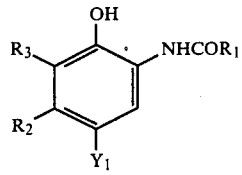

[VI]

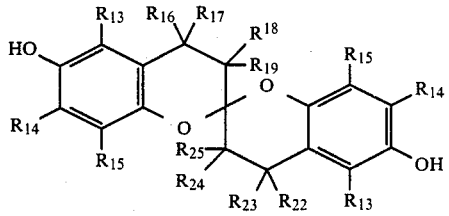

wherein:

$R_1$ represents a substituted or unsubstituted aliphatic group, a substituted or unsubstituted aromatic group or a substituted or unsubstituted heterocyclic group;

$R_2$ represents a substituted or unsubstituted aliphatic group;

$R_3$ represents a hydrogen atom, a halogen atom, a substituted or unsubstituted aliphatic group, a substituted or unsubstituted aromatic group or a substituted or unsubstituted acylamino group;

$Y_1$ represents a hydrogen atom, or a group or atom capable of being eliminated by a coupling reaction with an oxidized developing agent;

said compound represented by formula (I) may form a dimeric, oligomeric or polymeric coupler by means of groups $R_2$, $R_3$ and $Y_1$;

$R_{13}$, $R_{14}$ and $R_{15}$, which may be the same or different, each represents a hydrogen atom, an alkyl group, an alkenyl group, an aryl group, an alkoxy group, an aryloxy group, an alkylthio group, an arylthio group, an alkylamino group or an acylamino group, a halogen atom, an acyl group, an alkoxycarbonyl group, an aryloxycarbonyl group, an acyloxy group, a sulfonyl group, a sulfamoyl group, a sulfonamide group or a heterocyclic group, and two groups located at an adjacent position to each other among the groups $R_{13}$, $R_{14}$ and $R_{15}$ may be connected to each other to form a 5 to 7 membered cycloaliphatic, aromatic, heterocyclic or heteroaromatic ring;

$R_{16}$, $R_{17}$, $R_{18}$, $R_{19}$, $R_{22}$, $R_{23}$, $R_{24}$, and $R_{25}$, which may be the same or different, each represents a hydrogen atom, an alkyl group, an alkenyl group, an aryl group, an alkoxy group, an aryloxy group, an alkoxycarbonyl group, an aryloxy-carbonyl group, an amide group, a hydroxyl group, or a halogen atom and any two groups selected from $R_{16}$ through $R_{19}$ may form a 5 or 6 membered ring.

2. The color photographic material as described in claim 1 wherein, in formula [I], $R_1$ is selected from a substituted or unsubstituted alkyl or aryl group, $R_2$ is selected from an unsubstituted alkyl group containing 2 to 15 carbon atoms or a methyl group substituted by one or more substituents containing at least one carbon atom, and $R_3$ is selected from a hydrogen atom or a halogen atom.

3. The color photographic material as described in claim 2 wherein, in formula [I], $R_2$ is an alkyl group containing 2 to 15 carbon atoms and $R_3$ is a chlorine atom.

4. The color photographic material as described in claim 1, wherein $R_1$ represents an aliphatic hydrocarbon group containing 1 to 31 carbon atoms, an aryl group containing 6 to 31 carbon atoms or a heterocyclic group containing 1–31 carbon atoms.

5. The color photographic material as described in claim 1 wherein, in formulae [I], $Y_1$ and is selected from a hydrogen atom, a halogen atom and a substituted or unsubstituted alkoxy, aryloxy or sulfonamido group.

6. The color photographic material as described in claim 5 wherein, in formula [I], $Y_1$ and is a halogen atom.

7. The color photographic material as described in claim 1 wherein said compound selected from the compound represented by formula [VI] is included in the same silver halide emulsion layer as said cyan dye forming coupler.

8. The color photographic material as described in claim 1 wherein said coupler solvent is selected from the group consisting of phthalic acid esters, esters of phosphoric or phosphonic acids, benzoic acid esters, aliphatic carboxylic acid esters and aromatic esters.

9. The color photographic material as described in claim 8 wherein said coupler solvent is selected from esters of phosphoric or phosphonic acids.

10. The color photographic material as described in claim 1 wherein said coupler solvents are used in a range up to 150 weight % based on the amount of said cyan couplers.

11. The color photographic material as described in claim 1 wherein said compounds represented by formula [VI] may be added to a silver halide emulsion layer in an amount of 0.005 to 2.0 moles per mol of said cyan couplers.

12. The color photographic material as described in claim 1 wherein in combination with said cyan couplers other color couplers are employed.

13. The color photographic material as described in claim 1, wherein the substituted aliphatic group, the substituted aromatic group and the substituted heterocyclic group have substituents selected from the group consisting of an alkyl group, an aryl group, a heterocyclic group, an alkoxy group, an aryloxy group, an acyl group, an ester group, an amido group, a carbamoyl group, a sulfamoyl group, an imido group, a ureido group, a sulfonyl group, an aliphatic or aromatic thio group, a hydroxyl group, a cyano group, a carboxyl group, a nitro group, a sulfo group and a halogen atom.

14. The color photographic material as described in claim 1, wherein $R_1$ is an alkyl group substituted with an aryloxy group.

15. The color photographic material as described in claim 1, wherein $R_2$ is an unsubstituted alkyl group containing 2 to 15 carbon atoms or a methyl group substituted by one or more substituents containing at least one carbon atom selected from the group consisting of an arylthio group, an alkylthio group, an acylamino group, an aryloxy group and an alkyloxy group.

16. The color photographic material as described in claim 1, wherein $R_2$ is an ethyl group or a propyl group.

17. The color photographic material as described in claim 1, wherein $R_3$ is chlorine or fluorine.

18. The color photographic material as described in claim 1, wherein $R_2$ is selected from the group consisting of methyl, ethyl, propyl, butyl, pentadecyl, tert-butyl, cyclohexyl, cyclohexylmethyl, phenylthiomethyl, dodecyloxyphenylthiomethyl, butaneamidomethyl or methoxymethyl.

19. The color photographic material as described in claim 1, wherein $R_3$ is a lower alkyl group containing 1 to 5 carbon atoms, an aryl group or an acylamino group.

* * * * *